US010777879B2

(12) United States Patent
Diaz et al.

(10) Patent No.: US 10,777,879 B2
(45) Date of Patent: Sep. 15, 2020

(54) OPTIMAL PERMEABLE ANTENNA FLUX CHANNELS FOR CONFORMAL APPLICATIONS

(71) Applicants: Rodolfo E. Diaz, Phoenix, AZ (US); Tara Yousefi, Tempe, AZ (US)

(72) Inventors: Rodolfo E. Diaz, Phoenix, AZ (US); Tara Yousefi, Tempe, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 135 days.

(21) Appl. No.: 16/044,324

(22) Filed: Jul. 24, 2018

(65) Prior Publication Data

US 2019/0131697 A1 May 2, 2019

Related U.S. Application Data

(60) Provisional application No. 62/536,396, filed on Jul. 24, 2017.

(51) Int. Cl.
*H01Q 1/36* (2006.01)
*H01Q 1/48* (2006.01)

(52) U.S. Cl.
CPC ..... *H01Q 1/362* (2013.01); *H01Q 1/36* (2013.01); *H01Q 1/48* (2013.01)

(58) Field of Classification Search
CPC ..... H01Q 1/362; H01Q 1/36; H01Q 1/48
USPC ..... 343/787
See application file for complete search history.

(56) References Cited

U.S. PATENT DOCUMENTS 6,473,048 B1 10/2002 Diaz
6,980,716 B1 12/2005 Diaz et al.
7,132,640 B2 * 11/2006 Diaz ..... G01N 21/47 250/216
7,786,946 B2 8/2010 Diaz et al.
7,889,148 B2 2/2011 Diaz et al.
7,889,149 B2 2/2011 Diaz et al.
8,324,894 B2 12/2012 Diaz et al.
(Continued)

FOREIGN PATENT DOCUMENTS

WO 0033414 A3 6/2000
WO 03081715 A2 10/2003
(Continued)

OTHER PUBLICATIONS

Adenot, A.L., et al., "Tuneable microstrip device controlled by a weak magnetic field using ferromagnetic laminations", Journal of Applied Physics, vol. 87, No. 9, May 1, 2000, 3 pages.
(Continued)

*Primary Examiner* — Hai V Tran
(74) *Attorney, Agent, or Firm* — Schwabe, Williamson & Wyatt, P.C.

(57) ABSTRACT

Permeable antennas are presented. In embodiments, a permeable antenna may include a flux channel comprising a permeable material inside a trough in a conducting ground plane, the trough having a depth d and a width b; and a capacitive shunt admittance provided at the mouth of the trough. In embodiments, the capacitive shunt admittance may be one of: a slitted conducting plane or a single feed parallel solenoid, fed by a transmission line at a center loop. In embodiments, the conducting material may be anisotropic, and may include a ferromagnetic laminate comprising alternating thin metal films with thin insulating dielectrics. Related methods of providing permeable antennas are also presented.

18 Claims, 30 Drawing Sheets

(56) References Cited

U.S. PATENT DOCUMENTS

| | | | | |
|---|---|---|---|---|
| 8,686,918 | B1 * | 4/2014 | Diaz | H01Q 9/0485 343/742 |
| 8,847,846 | B1 * | 9/2014 | Diaz | H01Q 9/27 343/700 MS |
| 8,952,857 | B2 | 2/2015 | Diaz | |
| 10,020,581 | B2 | 7/2018 | Diaz et al. | |
| 10,111,612 | B2 | 10/2018 | Diaz et al. | |
| 2002/0180654 | A1 * | 12/2002 | Acher | H01Q 9/04 343/767 |
| 2015/0171157 | A1 * | 6/2015 | Sturcken | H01L 23/5223 257/531 |
| 2016/0365642 | A1 * | 12/2016 | Diaz | H01Q 7/06 |
| 2018/0175507 | A1 | 6/2018 | Diaz et al. | |
| 2019/0378638 | A1 | 12/2019 | Liu et al. | |

FOREIGN PATENT DOCUMENTS

| | | | |
|---|---|---|---|
| WO | 2004044179 | A2 | 5/2004 |
| WO | 2008079391 | A1 | 7/2008 |
| WO | 2010025470 | A2 | 3/2010 |
| WO | 2016134107 | A1 | 8/2016 |

OTHER PUBLICATIONS

Adenot-Engelvin, A.L., "Microwave properties of ferromagnetic compsites and metamaterials", Journal of the European Ceramic Society 27 (2007), pp. 1029-1033.

Auckland, et al., "A New Type of Conformal Antenna Using Magnetic Flux Channels," IEEE Military Communications Conference (MILCOM) 2014 IEEE, pp. 372-375.

Sebastian, T., "Magneto-Dielectric Wire Antennas Theory and Design", Dissertation, May 2013, 214 pages.

Sebastian, T., et al., "A New Realization of an Efficient Broadband Conformal Magnetic Current Dipole Antenna", IEE APS International Symposium (APSURI), 2013, pp. 1290-1291.

Walser, et al., "Shape-Optimized Ferromagnetic Particles with Maximum Theoretical Microwave Susceptibility," IEEE Transactions on Magnetics, vol. 34, No. 4, Jul. 1998, pp. 1390-1392.

Weeks, W.L., "Electromagnetic Theory for Engineering Applications", Section 3.6 Transverse Resonance Procedure for the Determination of Propagation Constants, 1964, pp. 246-250.

Yousefi, T., et al., "Pushing the limits of radiofrequency (RF) neuronal telemetry", Scientific Reports, 5:10588, Jun. 2, 2015, 16 pages.

Yousefi, T., et al., "A Wideband Multimode Permeable Conformal Antenna Thinner Than λ/75 Using Advanced Ferromagnetic Laminate Composite Materials", IEEE Antennas and Wireless Propogation Letters, vol. 15, 2016, pp. 1931-1934.

Yousefi, T., et al., "Why the Magnetic Loss Tangent Is Not a Relevant Constraint for Permeable Conformal Antennas", IEE Transactions on Antennas and Propagation, vol. 64, No. 7, Jul. 2016, pp. 2784-2796.

Yousefi, T., et al., "A First-Order Model of the Multiple-Feed Toroidal Magneto-Dielectric Antenna", IEEE Transactions on Antennas and Propagation, vol. 65, No. 11, Nov. 2017, pp. 5796-5807.

* cited by examiner

5·19. Inductive Strips.—An infinitely extended plane grating formed by metallic strips of zero thickness with edges parallel to the electric field (plane wave in free space incident at angle $\theta$).

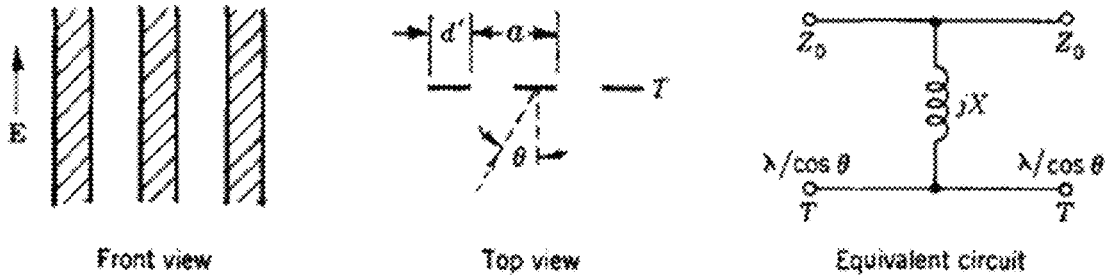

FIG. 5·19-1.

*Equivalent-circuit Parameters.*—At the terminal plane $T$ $$\frac{X}{Z_0} = \frac{a\cos\theta}{\lambda}\left\{\ln\csc\frac{\pi d'}{2a} + \frac{1}{2}\frac{(1-\beta^2)^2\left[\left(1-\frac{\beta^2}{4}\right)(A_+ + A_-) + 4\beta^2 A_+ A_-\right]}{\left(1-\frac{\beta^2}{4}\right) + \beta^2\left(1+\frac{\beta^2}{2}-\frac{\beta^4}{8}\right)(A_+ + A_-) + 2\beta^2 A_+ A_-}\right\}, \quad (1a)$$

$$\frac{X}{Z_0} = \frac{a\cos\theta}{\lambda}\left[\ln\frac{2a}{\pi d'} + \frac{1}{2}(3 - 2\cos^2\theta)\left(\frac{a}{\lambda}\right)^2\right], \quad \frac{d'}{a} \ll 1, \quad \frac{a}{\lambda} \ll 1, \quad (1b)$$

where $$A_\pm = \frac{1}{\sqrt{1 \pm \frac{2a\sin\theta}{\lambda} - \left(\frac{a\cos\theta}{\lambda}\right)^2}} - 1,$$

$$\beta = \sin\frac{\pi d'}{2a}.$$

FIG.7

The desired guided mode with longitudinal B field and azimuthal TE Electric field is set up differently for the two orientations of the laminate on the ground

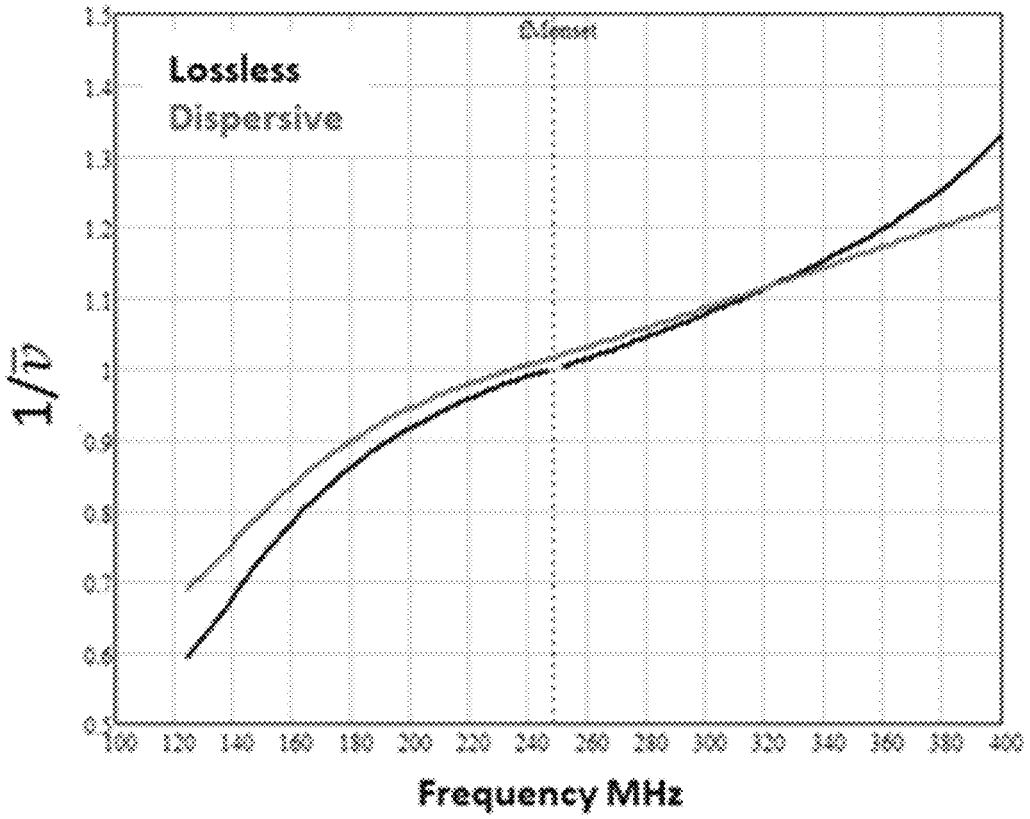
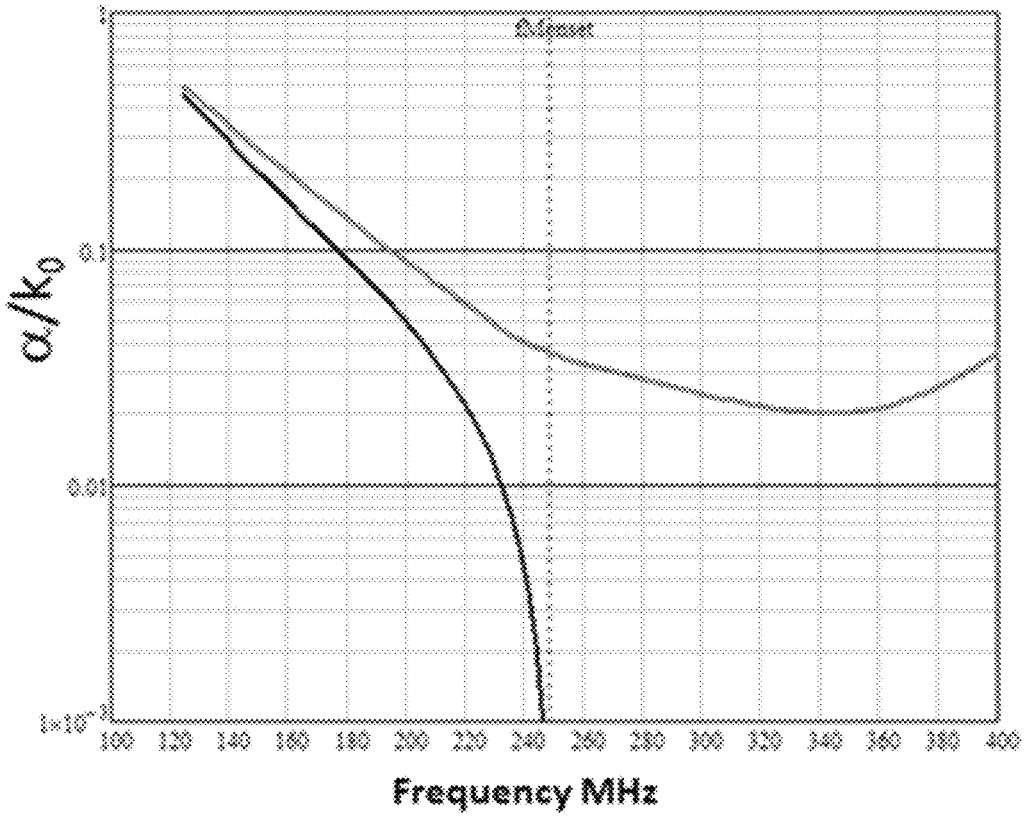
FIG.18

2520
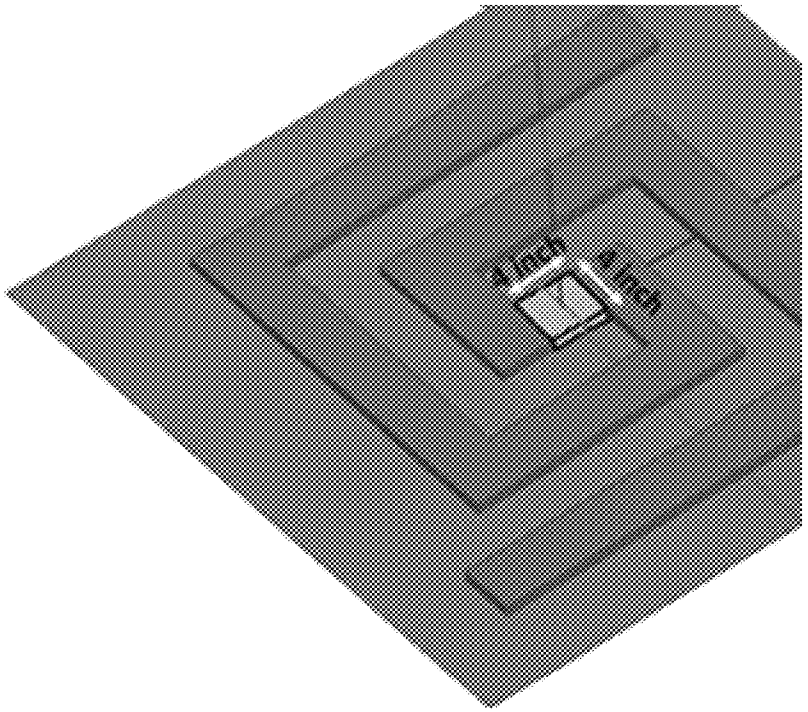
2510
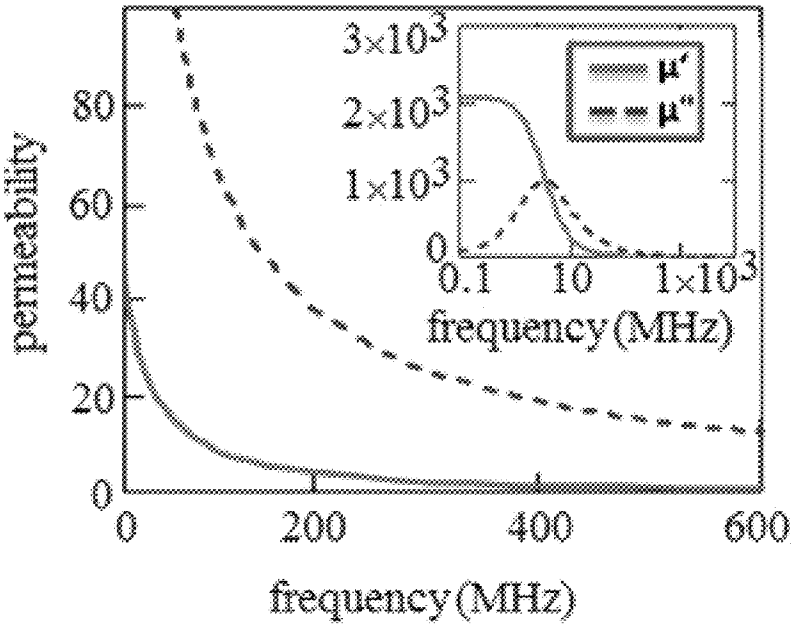
FIG.25

Material in trough may be a CZN ferromagnetic laminate with metal planes perpendicular to the bottom of the trough.

Permeability of CZN material

OPTIMAL PERMEABLE ANTENNA FLUX CHANNELS FOR CONFORMAL APPLICATIONS

CLAIM OF PRIORITY

This application claims the benefit of U.S. Provisional Patent Application No. 62/536,396, filed on Jul. 24, 2017, the entire disclosure of which is hereby incorporated herein by this reference, as if fully set forth.

STATEMENT OF GOVERNMENT SUPPORT

This invention was made with government support under N68335-12-C-0063, N68335-13-C-0082, and N68335-16-C-0082 awarded by the Department of Defense. The government has certain rights in the invention.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

Embodiments of the invention relate generally to antennas, and more particularly to optimal permeable antenna flux channels for conformal applications.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which, in and of themselves, may also correspond to embodiments of the claimed inventions.

It is desirable to obtain optimal true magnetic antennas (also known as permeable antennas or magnetic flux channel antennas). These antennas have recently been demonstrated to exhibit extraordinary efficiency in conformal antenna applications. These antennas constitute the most advanced members of a family of antennas that began with the ferrite dipole in the 1950's and includes the mast-clamp antenna, and other ferrite based antennas, for example.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

FIG. 7 is an extracted page from *Waveguide Handbook* discussing a wire gird construct as shown in FIGS. 5A through 5C.

FIG. 18 illustrates a comparison of a fictitious material with lossless frequency to a realistic material with dispersive permeability.

FIG. 25 illustrates the permeability of example NiZn ferrite tiles, according to various embodiments.

DETAILED DESCRIPTION

Figure 1:
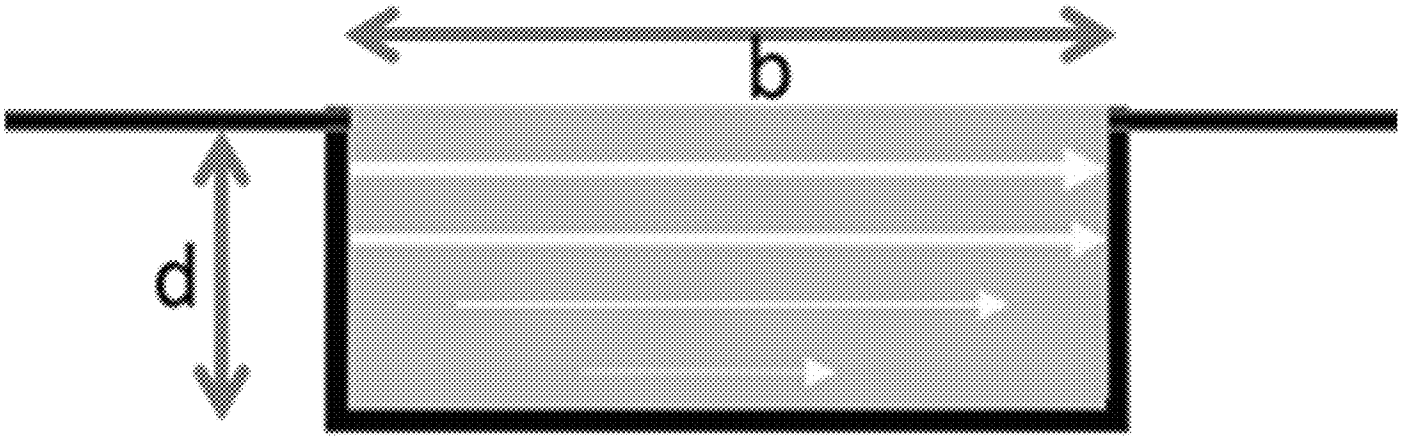
FIG. 1 depicts an example conducting trough in a conducting ground plane having a rectangular cross-section of depth d and width b according to various embodiments.

A prototypical magnetic flux channel antenna, as described for example below, may be seen as an infinitely long conducting trough in a ground plane filled with permeable material ($\mu_r > \varepsilon_r$). For purposes of deriving and verifying a design procedure it is noted that, as described in detail below, an antenna's electromagnetic behavior may be accurately modelled with a "principal mode" Green function model over the band of interest, and may further be approximately modeled in the neighborhood of the surface wave onset frequency with a Transverse Resonance Method (TRM) model. This has been verified by the inventors hereof by comparing such models to a full physics simulation using industry standard computational electromagnetics simulation environments (e.g., ANSYS' HFSS software) as well as using Arizona State University's (in-house) Finite Difference Time Domain code.

It is noted that one reason that behavior near the surface wave onset frequency is important is that in that frequency range a magnetic flux channel may guide an electromagnetic wave over its surface at approximately the speed of light. The magnetic field flux lines of such a guided wave terminate in the channel. Thus, this wave is the electromagnetic dual of the wave guided by metal conductors used in conventional antennas. (It is noted that Electromagnetic Duality means that the field structure of one solution to Maxwell's equation is identical to that of its complementary solution where the E and H fields are interchanged and μ and ε of all the materials forming the boundary conditions of the problem are also interchanged). Therefore, in this frequency range the magnetic flux channel behaves most like a magnetic conductor and antennas now implemented with metals, may be duplicated with identical antennas made from magnetic flux channels.

An advantage of magnetic flux channel dual antennas is that, in practical implementations, they may be conformal to a metallic surface. (This metallic surface then acts as the dual of the "open circuit" or perfectly magnetically conducting symmetry plane of their electric metal antenna counterparts.) This is important because electric antennas using metallic conductors to carry radiating electric currents may suffer a significant disadvantage when placed conformal to the conducting surface of a platform (e.g., air, land, or sea vehicle, or even the human body). They induce opposing image currents in the surface. On the other hand, it is noted, magnetic antennas have no such limitation. Radiating magnetic currents produce co-linear (favorable) image currents in electrically conducting surfaces.

In the following description, various aspects of the illustrative implementations will be described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials and configurations are set forth in order to provide a thorough understanding of the illustrative implementations. However, it will be apparent to one skilled in the art that embodiments of the present disclosure may be practiced without the specific details. In other instances, well-known features are omitted or simplified in order not to obscure the illustrative implementations.

In the following detailed description, reference is made to the accompanying drawings which form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A and/or B" means (A), (B), (A) or (B), or (A and B). For the purposes of the present disclosure, the phrase "A, B, and/or C" means (A), (B), (C), (A and B), (A and C), (B and C), or (A, B and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

1. An Optimal Flux Channel

A baseline configuration of an optimal flux channel may include a conducting trough in a conducting ground plane, said trough having a nominally rectangular cross section of width b and depth d, filled with a permeable material (μr>εr), and carrying an electromagnetic wave with the TE01 rectangular mode field configuration inside the channel, as illustrated in FIG. 1. The principal magnetic field then flows along the channel (out of the figure) constituting the radiating magnetic current. In general, width b may be small compared to the wavelength. Thus, the surface wave onset frequency may be determined only by the depth of the trough and the composition of the material. The optimal flux channel is one that supports its guided wave close to the speed of light (nominally within +/−30% but preferably within +/−20% or lower) with minimized loss over a maximized frequency bandwidth. It is noted that the technical features and design procedure provided for various embodiments as described herein enable this goal.

It is noted that for a given depth (onset frequency) the wider the trough (the more material is used), the wider the frequency band over which the guided wave in the neighborhood of onset may travel close to the speed of light.

It is further noted that above this nominal band of operation, a wave is tightly bound (trapped) by the channel and may only radiate by reflection at discontinuities in the channel (e.g., the end of the antenna). In general a channel operating in this trapped-wave regime is less efficient than near onset, because only a (small) portion of the trapped wave is radiated at discontinuities, leading to maximum radiation occurring only over a narrow frequency band at which the finite structure resonates. Similarly, below the nominal band of operation, the guided wave is a leaky wave with phase velocity higher than the speed of light so that the energy input into the channel tends to radiate out immediately from the "feed" region. Again, antenna performance is sub-optimal in such a leaky-wave regime because the full length of the antenna is not available to efficiently couple the wave to free space radiation.

Figure 2B:
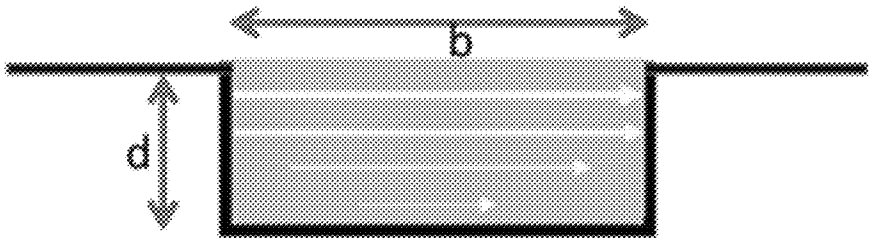
FIGS. 2A and 2B illustrate the difference between the trough implementation of the magnetic flux channel (FIG. 2B) and a conventional placement of permeable material on top of a ground plane (FIG. 2A).
Figure 2A:
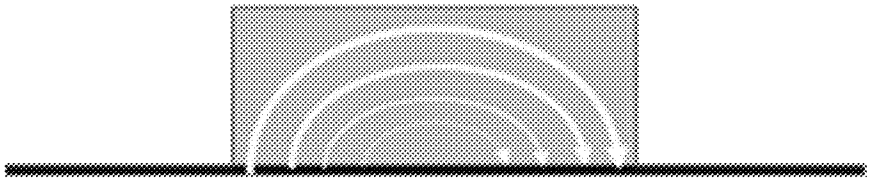

This ability to increase the operational frequency band without changing the onset frequency (at the expense of adding material) makes the trough implementation of the magnetic flux channel superior to a flux channel that results from simply placing a permeable material on top of the ground plane, as shown in FIG. 2A. It is noted that this added degree of freedom arises because the rectangular metal wall geometry constrains more strongly the polarization of the Electric field inside the material, making the lowest order mode inside the trough similar to a Cartesian TE01 waveguide mode inside the material as opposed to the more general (cylindrical dielectric-rod like) field structure in an open flux channel. The difference is illustrated in FIGS. 2A and 2B, where FIG. 2B illustrates the trough structure of FIG. 1.

In embodiments, the performance of a trough shaped antenna may be further enhanced by three key design features, as described below, in sections 1.1, 1.2 and 1.3, respectively.

1.1 Generalized Admittance Surface

It is noted that the onset frequency occurs when the transverse geometry of a trough first satisfies the Transverse Resonance condition. That is, when a quarter wave length of the guided wave fits in the thickness d, such that the TE01 mode's electric field is zero at the short circuit at the bottom of the trough and a maximum at the open mouth (which behaves like an open circuit.) As is known in waveguide resonator and filter design, the impedance of a mouth of a trough may be altered by adding a shunt admittance; e.g., covering an open mouth of an example trough with an admittance surface.

Figure 3:
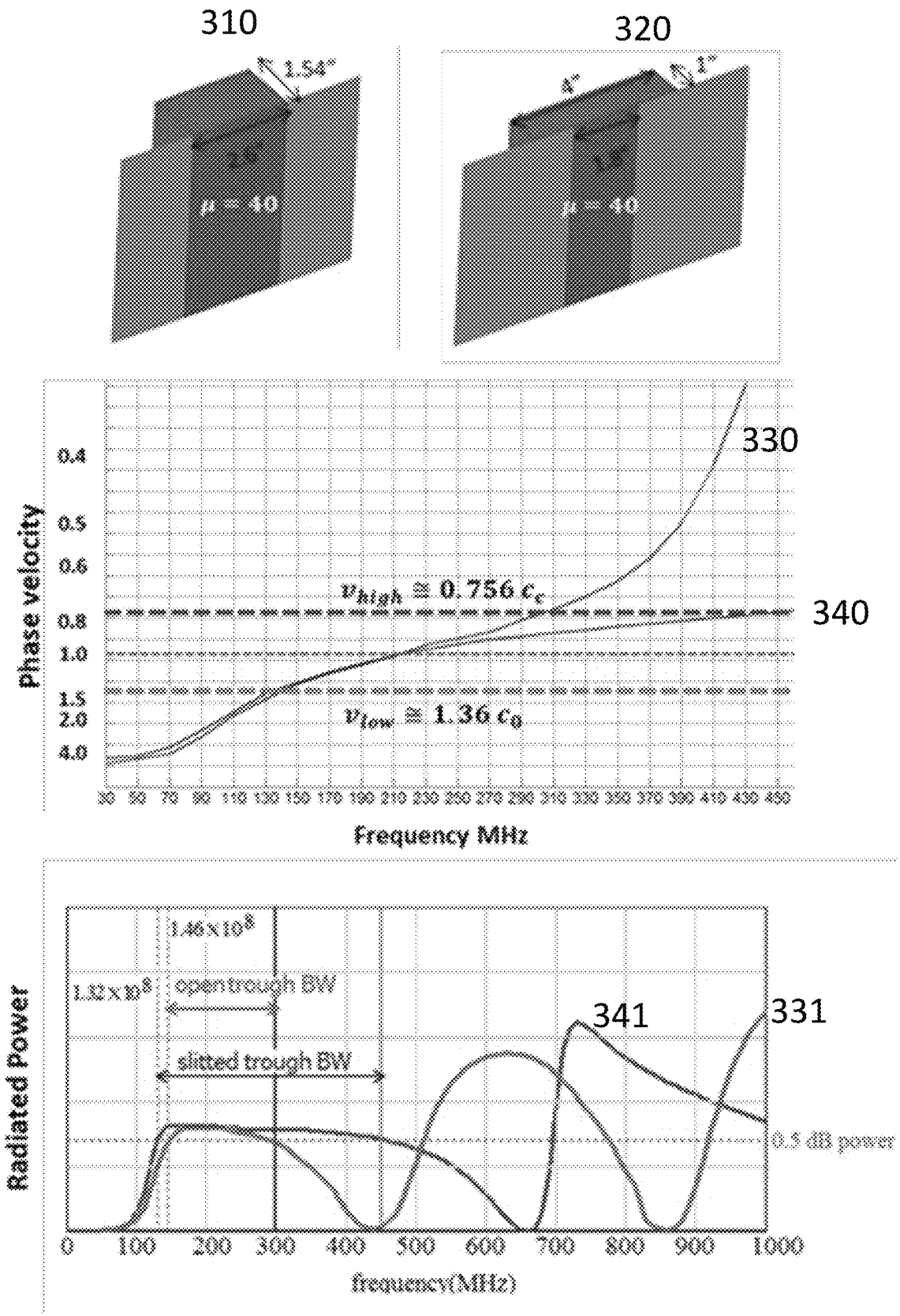
FIG. 3 illustrates the effect of adding a capacitive shunt admittance at the mouth of a trough implementation of an example waveguide according to various embodiments.

In particular, if a capacitive shunt admittance is added at the mouth then the thickness d required for quarter wave resonance is reduced. This means that a given desired onset frequency may be obtained by using a shallower trough than is possible with just an open trough. In embodiments, a simple implementation of a capacitive admittance sheet may be a slitted metal plane. Since the trough is now shallower, the same amount of permeable material may be retained and the trough made wider, as shown in FIG. 3 (right image). Therefore a trough may be obtained that has a much wider band of operation.

Thus, FIG. 3, two images provided at the top of the figure, illustrates two troughs containing the same amount of material (e.g., same cross sectional area of 4 square inches) of relative permeability 40 (assumed purely real for the sake of simplicity) and having relative permittivity 3.2, have been designed to have an onset frequency of 220 MHz. Trough 310 is a conventional design, whereas trough 320 is thinner and wider, as noted above. The maximum radiation band (over which 94% of the feed power may be radiated) has been determined to occur when the speed of propagation of the guide wave lies between 1.36 times the speed of light and 0.76 times the speed of light, e.g., between 0.76c and 1.36c. These values are denoted by the upper and lower dashed lines in the phase velocity plot at the center of FIG. 3. The conventional trough curve 330 crosses these boundaries at around 140 MHz and 300 MHz, respectively, as shown. By comparison, the slope of the slitted trough's curve 340 is much shallower than that for the conventional trough 330 so that it does not cross the upper edge of the maximum radiation band until 450 MHz.

These results are further confirmed in the bottom image of FIG. 3 (plot of Radiated Power v. Frequency) by direct calculation of the total power radiated to the far field. As may readily be seen, the slitted trough 341 has almost twice the operational frequency bandwidth as the conventional trough 331.

Figure 4:
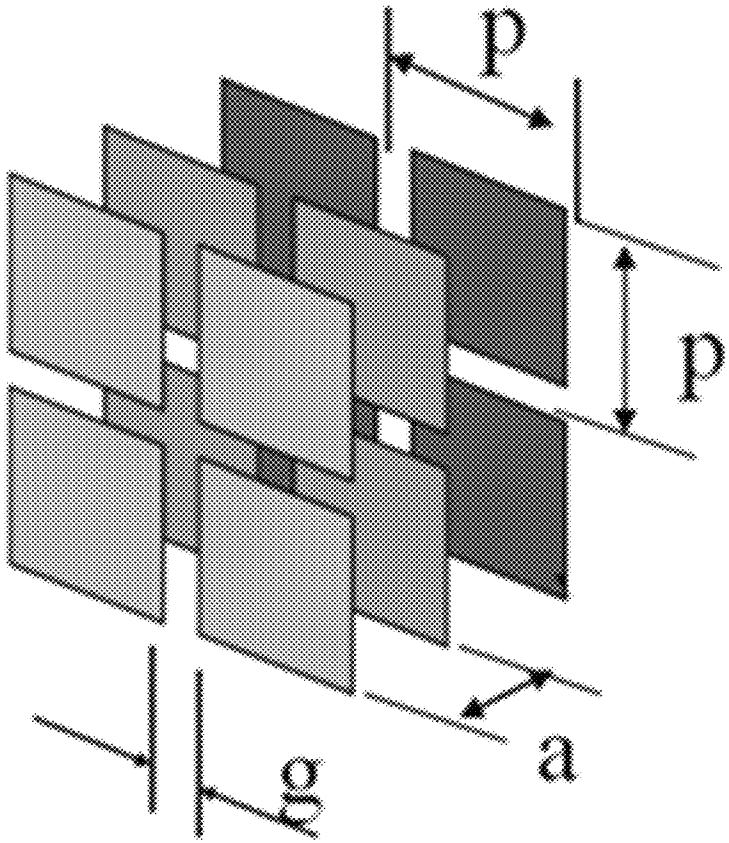
FIG. 4 illustrates an example capacitive admittance that may be implemented at a surface, according to various embodiments.

It is here noted that there are many ways of implementing a capacitive admittance at a surface. For example, a slitted conducting plane, as shown in FIG. 4, is perhaps the simplest one, and one for which a closed form expression of sheet capacitance is well known. Using it as an exemplary case does not limit the conceived technique to said implementation, however, it is to be understood. Thus, other well-known options may include, for example, a thin high dielectric constant slab covering a mouth of the trough, or, for example, a layer of printed circuit capacitive frequency selective surface (such as, for example, an array of metal squares, an array of overlapping metal squares, or the equivalent, as may be known from designs of artificial dielectrics). Any of these may be used in various embodiments.

Recognizing that the admittance at the mouth of the trough not only affects the propagation velocity of a guided wave but also the input impedance produced by said wave at the feed, it follows that a purely capacitive admittance is not the only advantageous implementation of this admittance surface. It is here noted that the parallel solenoid feed structure of U.S. Published Patent Application No. US2016/0365642 A1, published on Dec. 15, 2016, and entitled "Parallel Solenoid Feeds for Magnetic Antennas" is one example implementation of the slitted plane trough and may also be used in example implementations of the generalized admittance surface herein disclosed.

Figure 5A:
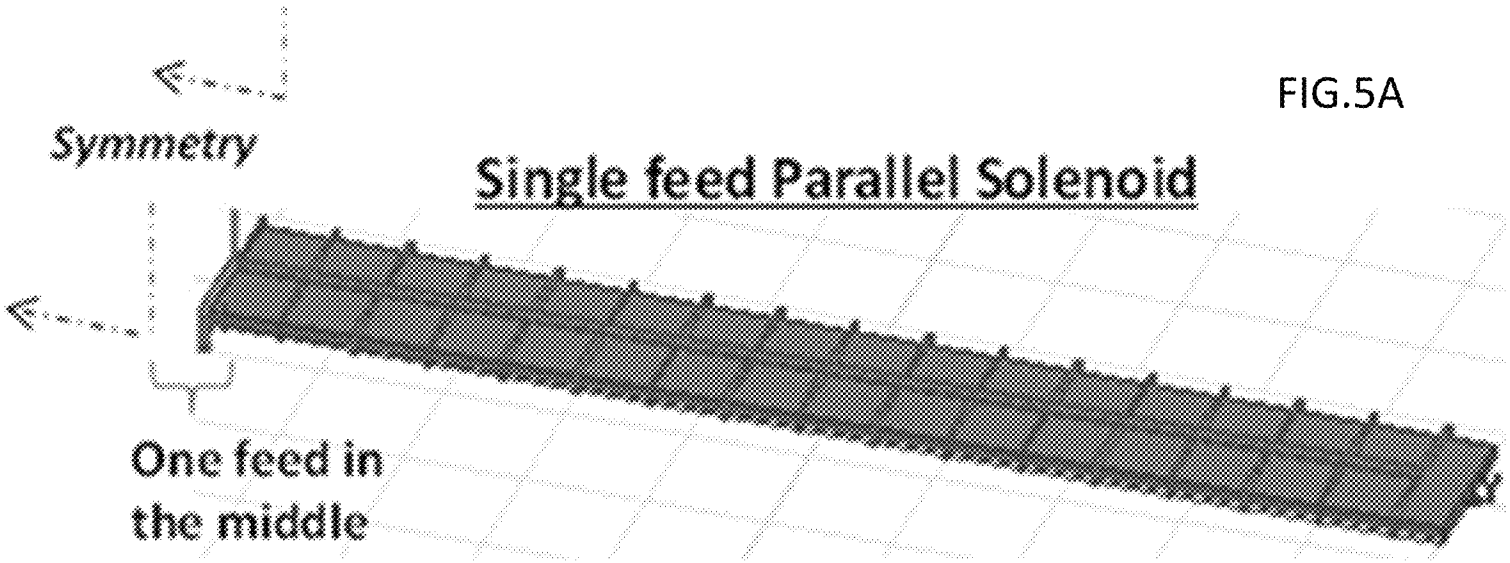
FIGS. 5A through 5C illustrate an alternate implementation of an admittance surface, a single feed parallel solenoid, according to various embodiments.
Figure 5B:
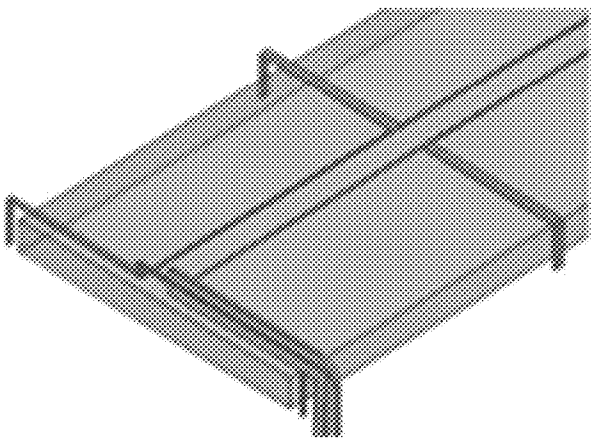
Figure 5C:
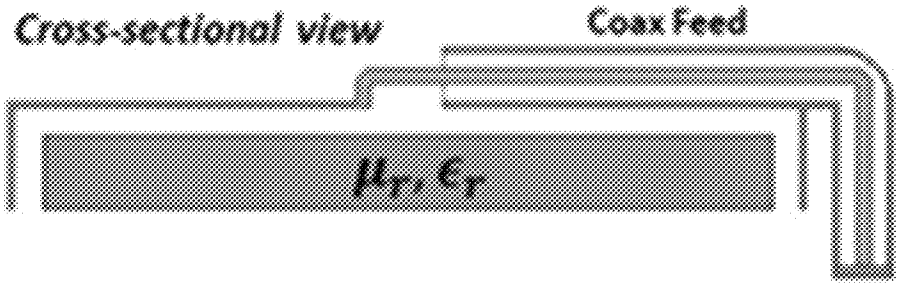

FIG. 5A illustrates an example half of a permeable dipole placed on an example conducting surface, fed by a coaxial transmission line at its center loop, according to various embodiments. The center loop is electrically connected by a two-wire transmission line to a series of parallel loops all surrounding the permeable material and terminating on the ground, as shown in FIGS. 5B and 5C.

Figure 6:
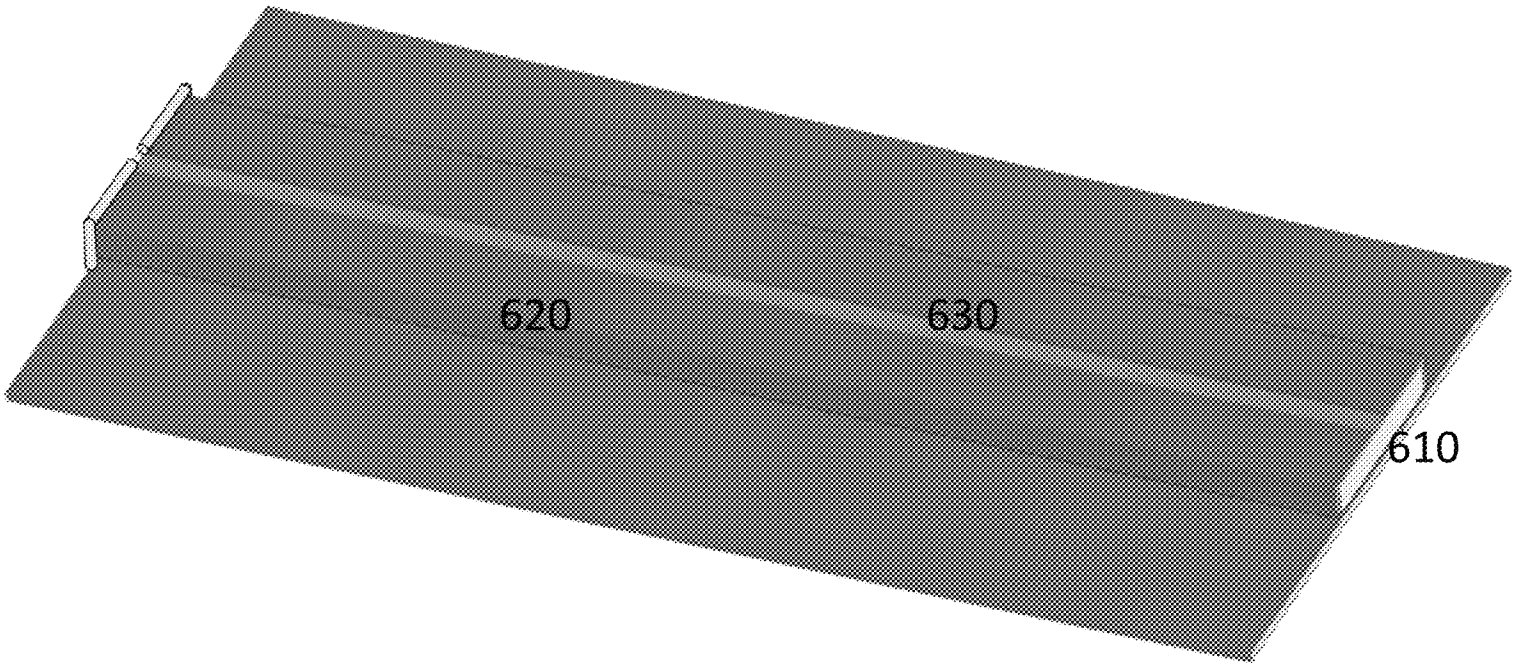
FIG. 6 illustrates an example slitted (or slotted) permeable trough on top of a grounding plane structure.

As shown in FIG. 6, if one imagines the spaces between the loops of the parallel solenoid and their connection to the twin-line filled with metal, one readily sees that the permeable material 610 has simply been surrounded by a rectangular metal enclosure 620 with a slit 630 at the top. In other words, this is a variation of the slitted permeable trough where the trough has here been moved to be on top of the conducting plane. The parallel solenoid may then recognized as an inductive grid version of the slitted plane, where the conducting planes bounding the slit have been replaced by a grid of wires.

Such a wire grid construct is known in microwave theory, the practice of frequency selective surfaces, and the design of electromagnetic wave polarizers. For example, it is discussed in Section 5.19 of the standard reference *Waveguide Handbook* by Marcuvitz, an image of which is provided in FIG. 7.

As an inductive shunt obstacle, the inductive grid presents a short circuit reflecting barrier to low frequency electromagnetic waves that becomes less and less reflective as frequency rises. That is, it is a frequency dependent short circuit. Since the flux channel antenna input impedance is also frequency dependent by nature, it is thus no surprise that tuning the frequency dependence of the conducting path of the slitted plane's admittance surface can be used as a design parameter to optimize the band of operation of magnetic flux channel antennas.

Figure 8B:
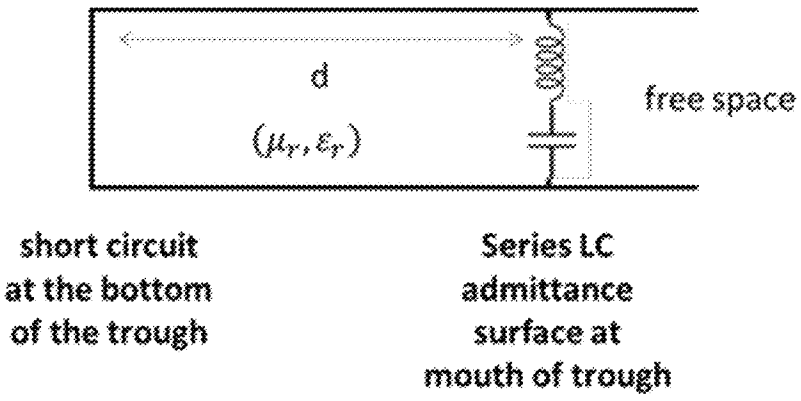
FIGS. 8A and 8B illustrate the difference from a transmission line model perspective between an example slitted plane admittance surface (pure capacitance at mouth of trough) and an example parallel solenoid (series LC circuit at mouth of trough).
Figure 8A:
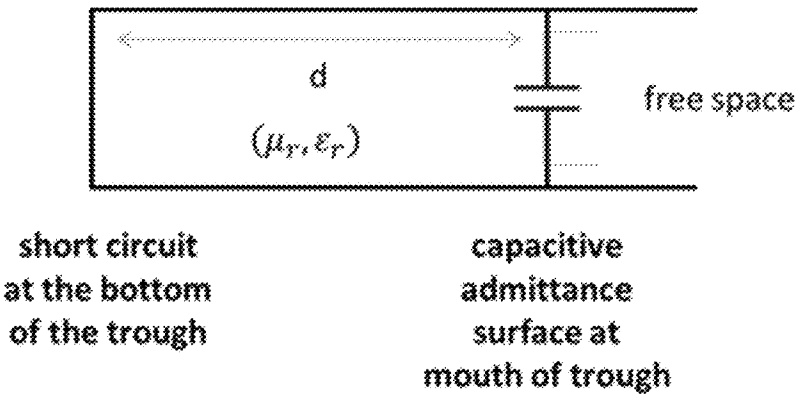

In embodiments, when the parallel solenoid works it does so because it is the appropriate generalized admittance surface required to maximize the radiation bandwidth of the given magnetic flux channel antenna. Thus, from the viewpoint of the transmission line model of the transverse resonance circuit of the flux channel, a parallel solenoid may be understood as an instance of terminating the channel with a shunt inductor-capacitor (LC) series circuit (where the inductors are the bars to ground and the capacitor is the gap between the two conductors of the two-wire line connecting the loops), as shown in FIG. 8B. This is as opposed to the nearly pure capacitance of the slitted plane, as shown in FIG. 8A.

It is noted that the inventors hereof have previously designed the first ever frequency independent permeable antenna, using an Archimedean spiral geometry constructed from NiZn ferrite tiles. It is further noted that conventional two-arm spiral antennas attain broad bandwidth of operation because they support a traveling wave along the winding wires that resonates at the active region of the dipole modes of the spherical wave spectrum.

Thus, for operation at a given frequency $f_0$, a wave from the feed of the spiral travels nearly at the speed of light along what is essentially a curved two-wire line (twin-line) until it reaches the active region at radius $r_{active}=\lambda_0/2\pi$, with perimeter$=\lambda_0$ the wavelength in free space at frequency $f_0$ (that is, $\lambda_0=c_0/f_0$). At this active region, over 90% of the guided wave radiates out. Since the size of the active region thus "scales" with frequency, a spiral antenna may operate over a broad band of frequencies only limited by the smallest and largest radii in its construction, namely, by the radius of its feed region and the radius at which the antenna arms are terminated. Therefore, to successfully create the electromagnetic dual of a spiral antenna for conformal applications it is needed to give the magnetic flux channel constructed from, for example, NiZn ferrite tiles, the ability to guide the wave along its entire length.

Full wave simulations and experiment show that simply feeding the spiral at its center does not accomplish this goal. However, in embodiments, feeding the ferrite spiral with a parallel solenoid with the correct number of loops to ground does accomplish it.

Figure 9:
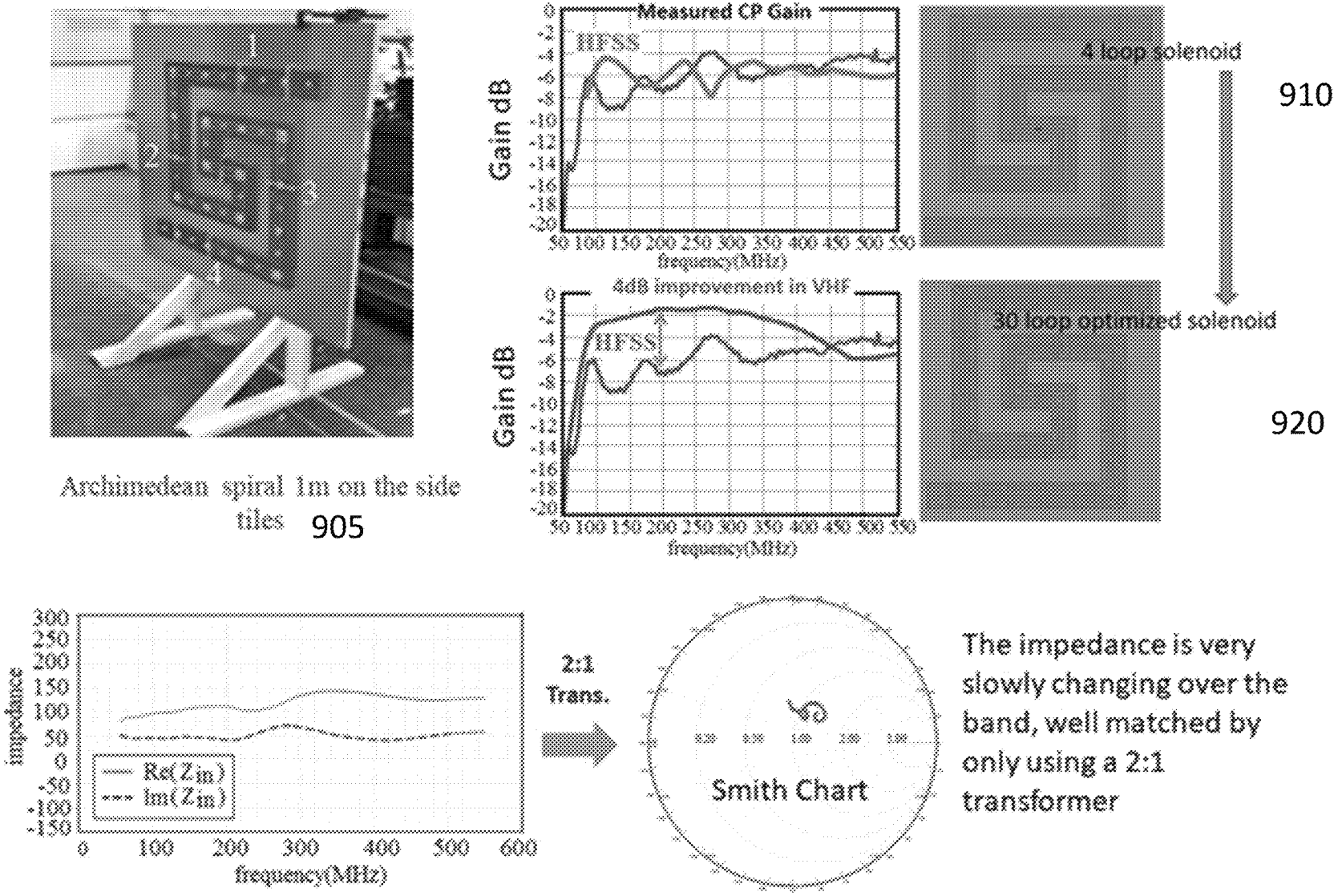
FIG. 9 illustrates an example ferrite spiral antenna fed by each of a 4-loop parallel solenoid and a 30 loop solenoid.

FIG. 9 shows (at top left) a photograph of a first version 905 of an example spiral antenna fed by a 4-loop parallel solenoid as illustrated in the CAD drawing 910 on the top right of FIG. 9. The measured performance matched computational simulations within expected measurement and fabrication uncertainties, as shown in the Gain DB v. frequency plot (middle top image). The next iteration of the parallel solenoid is shown in the lower CAD FIG. 920 and its performance in the second Gain DB v. frequency plot in the middle of FIG. 9. As may be seen, the design with 30 loops to ground 920 increases the Gain by up to 4 dB and smooths out the performance over the band. As the input impedance plots at the bottom of FIG. 9 show, the input impedance is indeed slowly varying with frequency and easily matched to a 50 ohm standard microwave system by simply using a 2:1 transformer.

In embodiments, these results may be improved significantly. Thus, in embodiments, a ferrite spiral such as depicted in FIG. 9 may be buried in a trough and a parallel solenoid used at its surface. This is shown in the top left image of FIG. 10. As also shown in FIG. 10, the performance of this example embodiment is even better with higher gain and an operational band from 50 MHz to 550 MHz.

Figure 10:
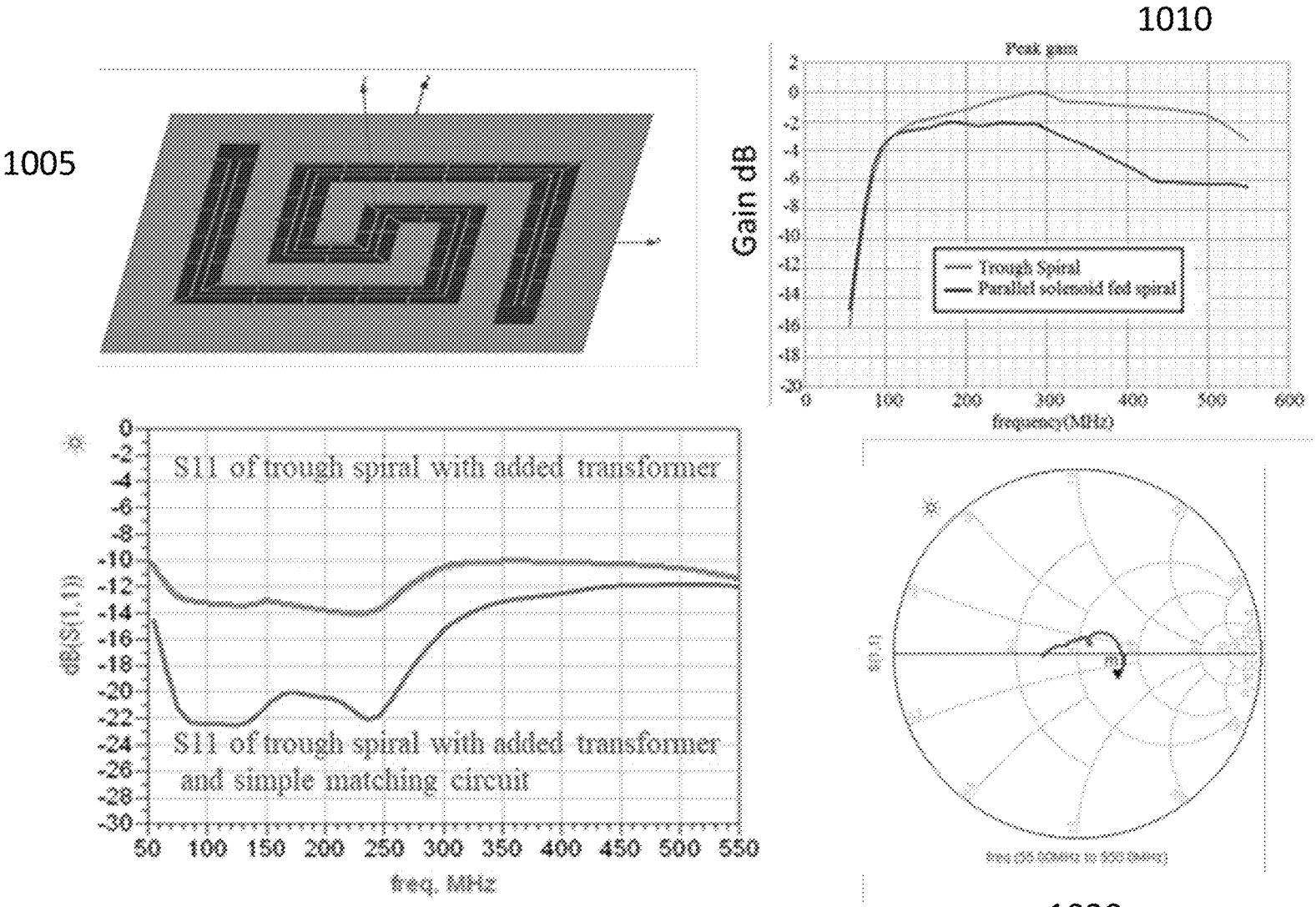
FIG. 10 illustrates an improved ferrite spiral antenna buried into a trough with a parallel solenoid used as its admittance surface, according to various embodiments.

Continuing with reference to FIG. 10, the CAD drawing at top left 1005 shows the ferrite tiles sunk into a conducting trough in the conducting surface leaving a small (nominally 3 mm) gap between the tile surface and the top edge of the trough. In embodiments, the parallel solenoid structure may then be placed across the mouth of the trough, the twin line running, as before, along the centerline of the ferrites and the loops to ground now simply being conducting bars connecting to the edges of the trough. As the plot 1010 in the top right shows, the Gain of this configuration is even higher than that of the best one in FIG. 9 (where the material was placed on top of the conducting ground plane). The Smith Chart plot 1030 on the bottom right of FIG. 10 shows that the example antenna 1005 is closely matched to a 50 ohm system with a simple matching circuit consisting of two capacitors and a transformer. Additionally, the S11 plot 1020 on the lower left (Input match, that is, Reflection coefficient at the feed as a function of frequency) shows that an operational frequency bandwidth from 50 MHz to 550 MHz (11:1) band may be obtained with better than a 2:1 Voltage Standing Wave Ratio (VSWR) match (better than −10 dB), thus demonstrating that true frequency independent permeable antennas may be constructed according to the methods herein presented.

It is here noted that the enhanced gain may be understood as arising in part due to the additional (favorable) images of the magnetic current that are produced on the sidewalls of the channel—as opposed to the case when the material is on top of the ground plane. Alternatively, the enhanced gain may be understood as arising from better confinement of the magnetic current resulting in a stronger flux as is obtained using flux concentrators in magnetic levitation melting.

Thus, in embodiments, a key element of the optimized permeable antenna is the creation of a flux channel in trough form that maximizes the radiation bandwidth of the antenna by (i) selecting the optimal modal structure of the desired Electric field inside the channel (TE01 Cartesian) and then (ii) covering the mouth of that trough channel with a generalized admittance surface that may, for example, be Capacitive (like the slitted plane), series inductive capacitive (like the parallel solenoid) or take the form of any other circuit that may include parallel combinations of inductors and capacitors (e.g., as in the gapped ring resonator structure) or even circuit constructs including resistive element for, say, terminating the antenna. In embodiments, these circuit constructs in the form of the admittance surface may be selected to modify not only the admittance at the mouth of the trough, and thus its effect on the propagation velocity of the guided wave, but also to optimize the level and bandwidth of the input impedance by compensating for the natural frequency dependence of the antenna resulting from its shape and the frequency dependent properties of its materials of construction.

It is here noted that a generalized admittance surface provides a "tool box" with a large number of degrees of freedom that may be used to optimize a given permeable antenna configuration, according to various embodiments. An example design process may then follow standard approaches of impedance matching and broad-banding or, for example, may be performed using computational tools and appropriate computational optimizers exploiting these degrees of freedom.

1.2 Enforcing Anisotropy in Construction Materials

In general, electromagnetic materials may possess anisotropic constitutive properties. That is, permittivity and permeability may depend on the direction of the applied field. In permeable ferromagnetic (metallic) and ferrimagnetic (ceramic) materials this anisotropy may be a result of the manufacturing process. However it may also be produced by methods of construction. In particular, ferromagnetic laminates, ferromagnetic artificial materials resulting from alternating thin metal films with thin insulating (non-magnetic) dielectrics, are anisotropic in both effective permittivity and effective permeability.

Figure 11:
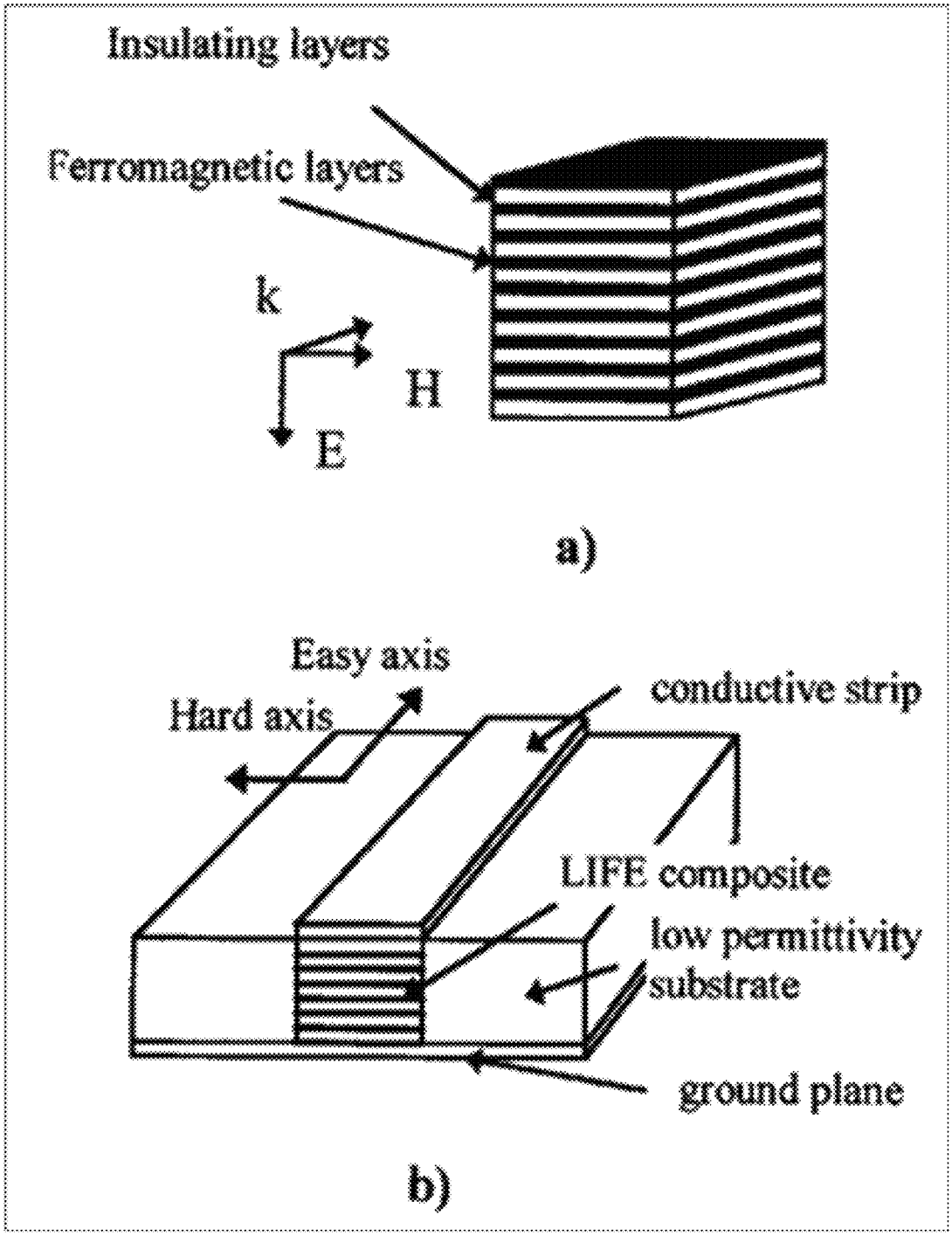
FIG. 11 illustrates an example ferromagnetic laminate structure.

It is noted the theory of these materials has been described, for example, in Adenot (A. L. Adenot-Engelvin et al., *Journal of the European Ceramic Society* 27 (2007) 1029-1033, and J. Appl. Phys., Vol. 87, No. 9, 1 May 2000, 6914-6916), which discusses such a ferromagnetic laminate and points out a simple approximation for the effective permeability parallel to the laminae and effective permittivity perpendicular to the laminae. It is noted that these may be most relevant to an application of placing the material under a microstrip, as shown, for example, in FIG. 11. The simple approximation may be given by:

$$\mu_{eff} = q\mu_i + 1 - q \text{ and } \epsilon_{eff} = \frac{\epsilon_m}{1-q}$$

where q is the volume fraction of the metal (ratio of thickness of metal film to the thickness of one period of the periodic arrangement (metal film thickness plus dielectric insulator thickness).

More accurately, full tensor expressions for the constitutive properties of such a laminated material may be given by:

$$\mu_{eff} = \begin{pmatrix} 1 + (\mu_{ix} - 1)\left(\frac{t_m}{t_m + t_d}\right) & 0 & 0 \\ 0 & 1 + (\mu_{iy} - 1)\left(\frac{t_m}{t_m + t_d}\right) & 0 \\ 0 & 0 & 1 \end{pmatrix}$$

$$\varepsilon_{eff} \cong \begin{pmatrix} 1 + \frac{(\varepsilon_{ix} - 1)t_d - j\frac{\sigma}{\omega\varepsilon_0}t_m}{t_m + t_d} & 0 & 0 \\ 0 & 1 + \frac{(\varepsilon_{iy} - 1)t_d - j\frac{\sigma}{\omega\varepsilon_0}t_m}{t_m + t_d} & 0 \\ 0 & 0 & \frac{\frac{\varepsilon_{iy}}{t_d}}{t_m + t_d} \end{pmatrix}$$

where the x-y plane is the plane of the laminate, z is the direction perpendicular to said plane, $\mu_{ix}$,$\mu_{iy}$ are intrinsic frequency dependent relative permeability properties of the permeable metal film in the x and y directions, and $\varepsilon_{ix}$, $\varepsilon_{iy}$, $\varepsilon_{iz}$ are the relative permittivities of the insulating dielectric in the three directions, and $\sigma$ is the conductivity of the metal films (assumed to be isotropic.)

Figures 12A, 12B:
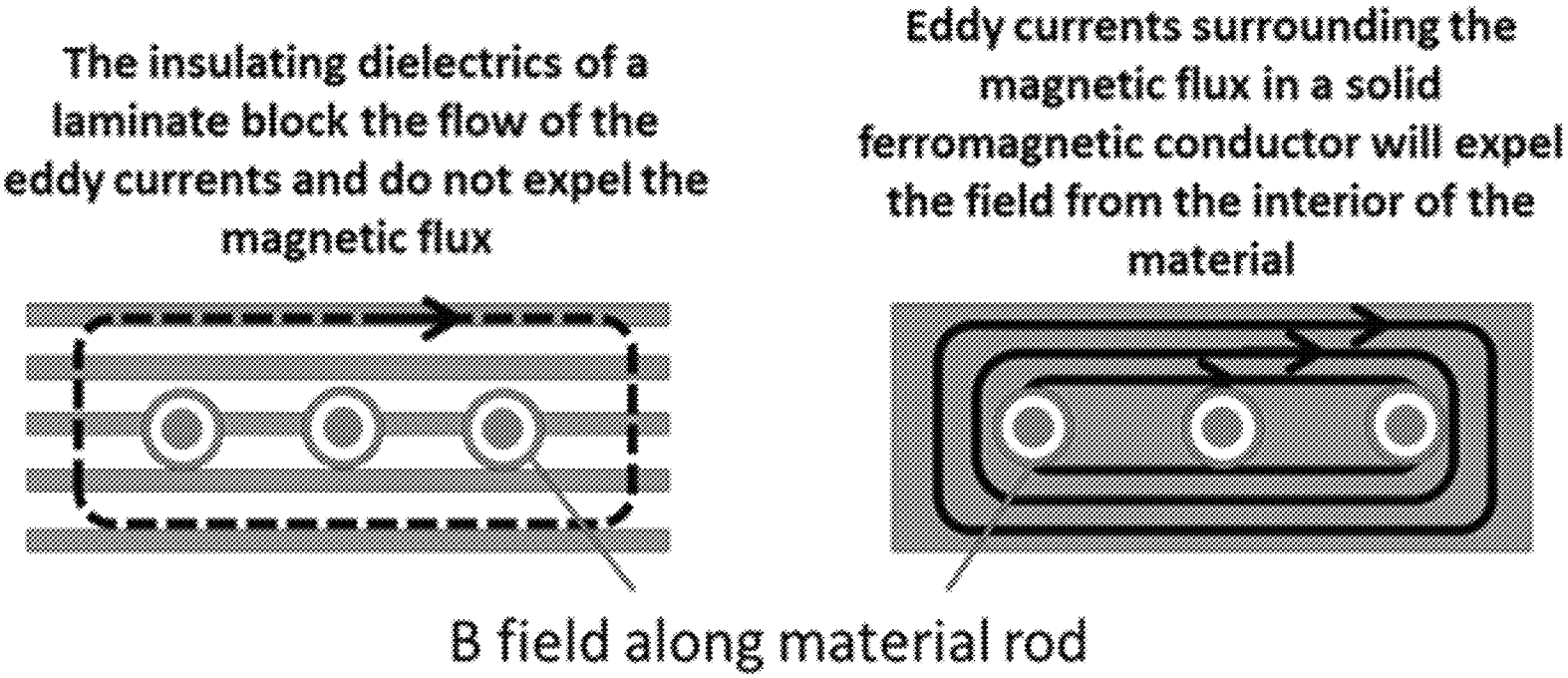
FIGS. 12A and 12B illustrate the difference in magnetic flux in a laminate structure (FIG. 12A) versus a solid ferromagnetic conductor (FIG. 12B).

In embodiments, metal films may be chosen to be thinner than the skin depth at the frequencies of use. In embodiments, the insulating dielectrics may then prevent circulating currents (in the X-Z or Y-Z planes) from propagating from one lamina to another. Thus, in such an example laminate material, magnetic flux may flow unimpededly along the X-Y plane without being blocked by eddy currents even though the total metal area in the cross section of the material may exceed many times the skin depth. This is illustrated in FIGS. 12A and 12B. FIG. 12A illustrates how insulating dielectrics of a laminate block the flow of eddy currents and do not expel the magnetic flux. On the other hand, FIG. 12B illustrates how eddy currents surrounding the magnetic flux in a solid ferromagnetic conductor may expel the field from the interior of the material.

It is here noted that an important result of the laminate structure and the tensor properties is that given the very high conductivity of the metal films, the x-y permittivity properties of the laminate material tend to be dominated by the metallic conductivity. Therefore, an example material behaves as a conductor in those two directions. This is why the intrinsic permeability of the ferromagnetic metal in the z direction is unimportant and labeled as 1 in the full tensor expression presented above. In practice, the magnetic field inside such a composite laminate material cannot penetrate in the z direction, as the eddy currents induced in the x-y metal planes completely block any magnetic flux from crossing them.

It is noted that many of the thin magnetic metal films used for laminates are intrinsically anisotropic so that, for instance, $\mu_{ix} \gg \mu_{iy}$. Thus, it is understood, in embodiments, a flux channel may preferably be designed such that the magnetic current flux flowing along the channel uses the high permeability orientation of the material.

Figures 13A, 13B:
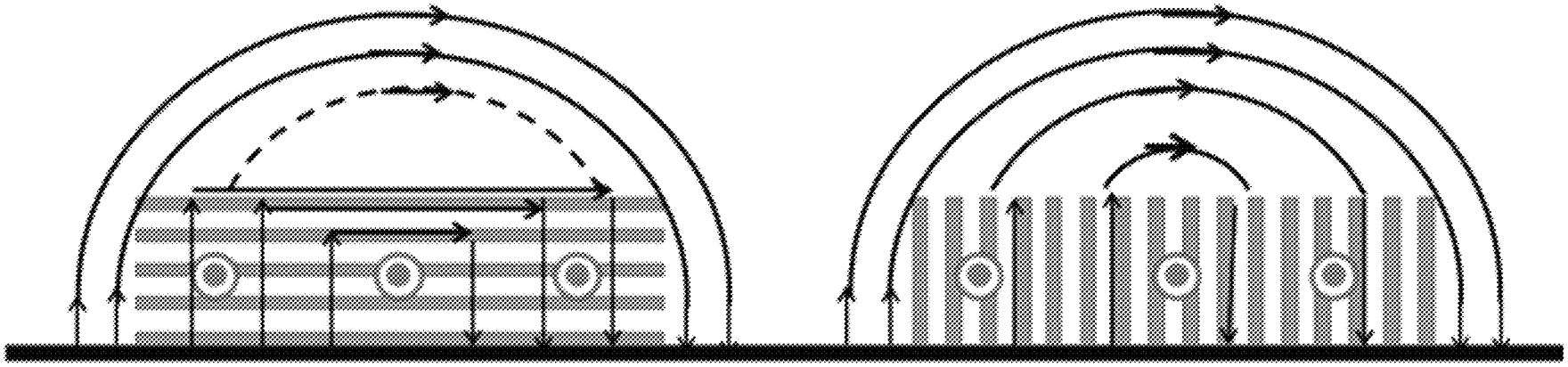
FIGS. 13A and 13B illustrate how two flux channels of identical cross-sectional area support the TE01 magneto-dielectric rod mode differently for different orientations of the laminate on the ground plane, according to various embodiments.

Moreover, this material anisotropy may be used in various embodiments to improve the performance of permeable antennas. For example, it is considered to use a ferromagnetic laminate material as the material of construction for a permeable antenna. When the flux channel is formed by placing the material on the surface of the ground plane, the laminate planes may either be placed perpendicular to, or parallel to, this ground plane. Even though both flux channels have the same cross sectional area, and the same permeability in the direction of the desired magnetic current, it is noted that they are not equivalent in performance. As shown in FIGS. 13A and 13B, they support the TE01 magneto-dielectric rod mode differently. In FIGS. 13A and 13B, the black arrows denote the Electric field while the "arrow heads" seen end-on in red concentric circles (flowing out of the page) denote the magnetic flux (magnetic current).

Because for conformal antennas it is desired to have the channel be as thin as possible, shallow and wide channels are preferred. The problem that arises is that the laminate structure, in addition to supporting the desired magneto-dielectric-rod-like TE01 field in the space surrounding the channel (as illustrated in FIG. 13) also supports a parasitic parallel plane TEM mode with the electric field terminating on the laminates and traveling parallel to (between) the laminate planes. Because it is always possible to excite this mode at asymmetries in an antenna feed structure, or at discontinuities in the antenna, it is always in danger of being excited.

Continuing with reference to FIG. 13, it is readily seen that the case of FIG. 13A looks like a stack of microstrip lines capable of carrying such a mode both along the length of the channel and transverse to it. The former would have its magnetic field, not longitudinal as desired for a magnetic current radiator, but transverse. Such a mode is the dual not of an antenna, but of two wire transmission lines and therefore makes for a very poor radiator. Based on this fact alone, the configuration with laminate planes parallel to the ground plane is not preferred. In various embodiments where manufacturing constraints require this orientation (horizontal laminates parallel to ground plane) a mode filter may be implemented, such as, for example, by inserting vertical conducting pins through the middle of the channel along its full length to short out the propagating transverse electromagnetic, or TEM mode.

Given the above, it is noted that the vertical laminate structure shown in FIG. 13B has a built-in mode filter against this traveling TEM wave mode, because the ground plane short circuits the TEM E field and prevents the TEM wave from ever propagating along the channel. As expected, at higher frequencies parasitic parallel plane transverse electric, or TE (waveguide like) modes may also propagate guided by the laminate plane structure. These would bounce from side to side transversely as they propagate along the channel. On this account too, in embodiments, a vertical laminate placement is to be preferred. As FIGS. 14A and 14B show, a shallow wide flux channel could start multi-moding and carrying this parasitic wave at lower frequencies if the laminates are parallel to the ground (FIG. 14A) than if they are perpendicular (FIG. 14B).

Figures 14A, 14B:
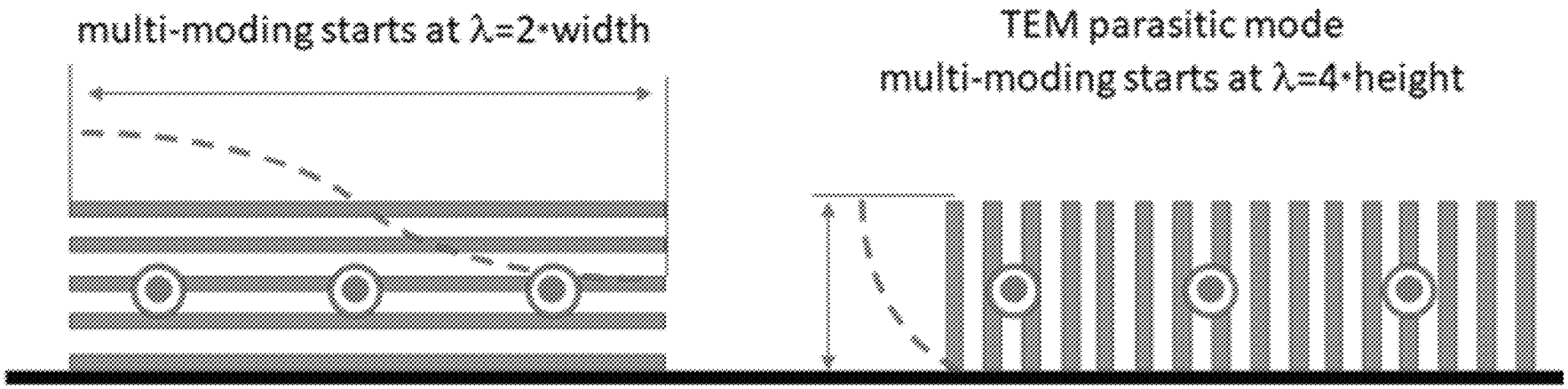
FIGS. 14A and 14B further illustrate the advantages of a vertical laminate (FIG. 14B) structure according to various embodiments.

Furthermore, the fact that the electric field has one full half wavelength variation along the channel for the case of FIG. 14A results in a poorly radiating mode because the magnetic current changes direction within the channel. However, the parasitic TE mode on the vertical laminates of FIG. 14B only has a quarter wave variation (shown by the dotted red line), meaning that the electric field all points in the same transverse direction and the longitudinal magnetic current also points in only one direction everywhere in the channel cross section.

Therefore the case of FIG. 14B with a TE mode traveling within the channel still produces the desired radiation and the mode is not really "parasitic." It can thus be surmised that for the flux channel with vertical laminates perpendicular to the ground plane, both the magnetodielectric rod TE01 desired mode and this TE mode coexist, and may contribute with possibly different strengths, to the radiation of the antenna. However, it is noted, if the two coexisting modes have different characteristic propagation velocities then interference between them may induce a frequency dependent variation into the electromagnetic properties of the channel.

Therefore, in embodiments, to maximize the bandwidth of operation and radiation efficiency of a magnetic flux channel constructed from a laminate structure placed on top of a ground plane, the preferred orientation for the laminates is where they are perpendicular to the ground plane, as shown in FIGS. 13B and 14B.

Figures 15A, 15B:
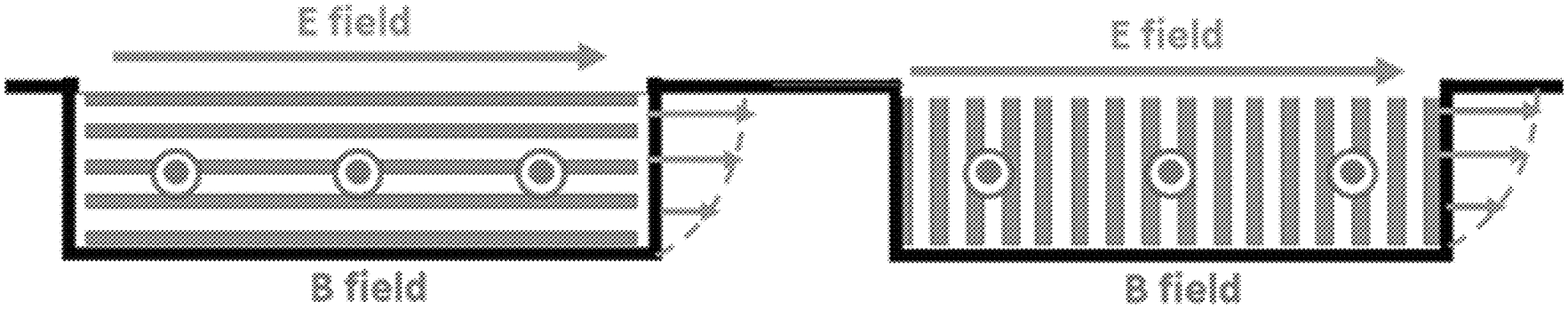
FIGS. 15A and 15B illustrate both the Electric and Magnetic fields in each of: example laminates parallel to the bottom of an example trough (FIG. 15A), and example laminates perpendicular to the bottom of the trough (FIG. 15B), according to various embodiments.

This restriction also holds, and even more strongly, for a flux channel in a trough configuration. As shown in FIGS. 15A and 15B, the desired propagating mode in the flux channel has a transverse E field (TE01 rectangular mode) that is a maximum at the mouth of the flux channel and a minimum (zero) at the bottom of the channel. Clearly, for laminates parallel to the bottom of the trough, as shown in FIG. 15A, the metal laminate surfaces short out this desired Electric field and make it very difficult to carry the desired mode in preference to a TEM mode trapped between the laminates. This fact was confirmed by the inventors by a full physics simulation of such a flux channel, where the onset frequency was found to occur at an anomalously high frequency, and the desired magnetic current was not adequately guided.

On the other hand, for laminates provided vertically perpendicular to the bottom of the trough, as in FIG. 15B, the mode enforced by the boundary conditions of the trough is exactly the TE mode as mentioned, that exists on the structure even when it is on the top of the ground. In other words, the trough configuration limits the propagation of the desired mode in the case of the vertical laminates to one unique lowest order mode.

In embodiments, supporting only one lowest order mode may be generally preferred whenever broadband electromagnetic structures are desired (avoiding any interference between multiple modes).

Thus, given the above analysis, knowledge of the modal structure supported by a laminated permeable material leads to a design criterion that dictates a preferred orientation of said laminates. However, in addition to dictating this preferred orientation (i.e. laminate planes perpendicular to the bottom of the trough as in FIGS. 13B, 14B and 15B) it is further disclosed that even in the case of a material of construction that is originally, by nature, isotropic, in embodiments it may be advantageous to render it anisotropic by adding conducting planes so as to enforce the behavior discussed above.

The reason for this becomes apparent upon considering extremely broadband applications, such as, for example, spiral antennas and log periodic antennas. As noted above, shallow and wide trough magnetic channels are preferred for conformal antennas, and offer the widest possible radiation bandwidth. In such applications the width b of the trough will eventually become long enough to exceed one wavelength. For instance, considering a trough that is 3.8 inches wide, 1.053 inches deep, and filled with a permeable material of $\mu r=80$ and $\varepsilon r=2$. Its onset frequency is 220 MHz. At that frequency the 1.053 inch depth is approximately a quarter wave in the permeable material. This means that the trough aperture, being almost four times larger than the depth, is already almost one wavelength across.

Figure 16:
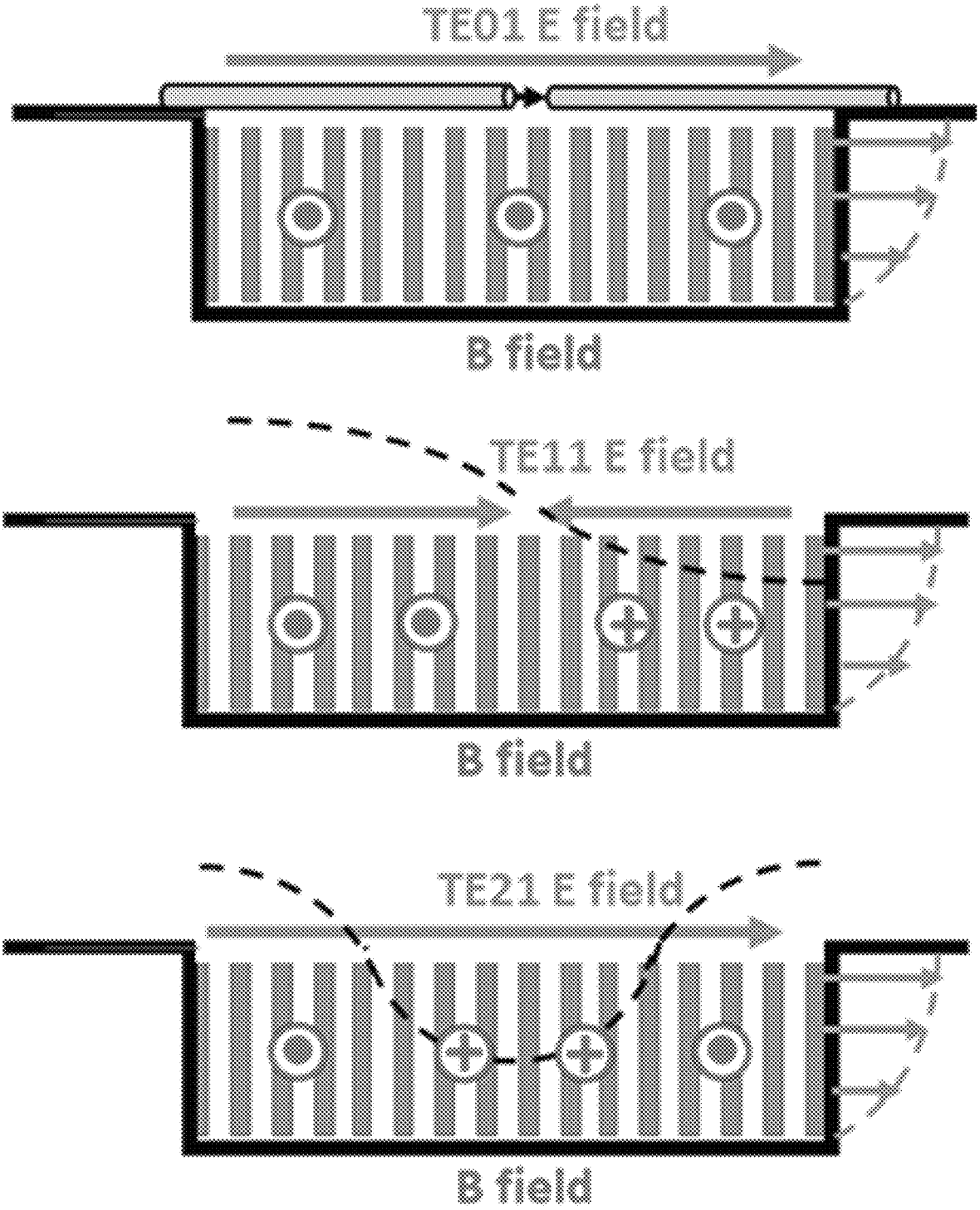
FIG. 16 illustrates the need for filling a channel with an anisotropic magneto-dielectric material, according to various embodiments.

As suggested by FIG. 16, a symmetrically disposed coax feed excites first the TE01 mode E field at the mouth of the trough, and by symmetry suppresses the odd TE11 mode. However, the TE21 mode also has even symmetry. This mode, with one wavelength variation across the trough, may therefore be excited at higher frequencies. Because its electric field changes direction, its corresponding magnetic current also changes direction inside the channel, and it is on the whole a very poor radiator.

As is known in waveguide design, whenever a higher order mode is to be suppressed, mode filters are indicated. Fortunately, for the ferromagnetic laminate permeable material described above, that mode filter is built-in. As shown in FIG. 16, bottom image, the vertical metal plates suppress the side to side propagation of the higher order TE21 mode because when that mode travels along the channel it carries a transverse magnetic field in addition to its longitudinal field. That field, perpendicular to the laminate planes, induces strong eddy currents in the planes of the laminates and thus the laminates tend to block it.

Therefore, it follows that when a permeable material available to fill the channel is not a ferromagnetic laminate, but a naturally homogenous isotropic material in embodiments, mode suppression may be accomplished by dividing the homogeneous isotropic permeable material into thin segments aligned with the flux channel axis, and separating these with thin metal planes. Thus, for example, in the case of a ferrite tile spiral antenna, to extend its range of operation into the GHz range, the 4 inch-wide tiles may be sliced into 1 inch wide sections, and thin copper plates may be inserted between these (or the faces between them painted with a conducting paint). By this procedure the frequency at which the undesirable TE21-like mode may be excited may be pushed up by a factor of 4.

Thus, in embodiments, a permeable material filling the channel may be converted into an anisotropic magneto-dielectric material with tensor constitutive properties equivalent to those of a ferromagnetic laminate. In embodiments, this is understood to be a useful feature to obtain an optimal permeable antenna.

Figure 17:
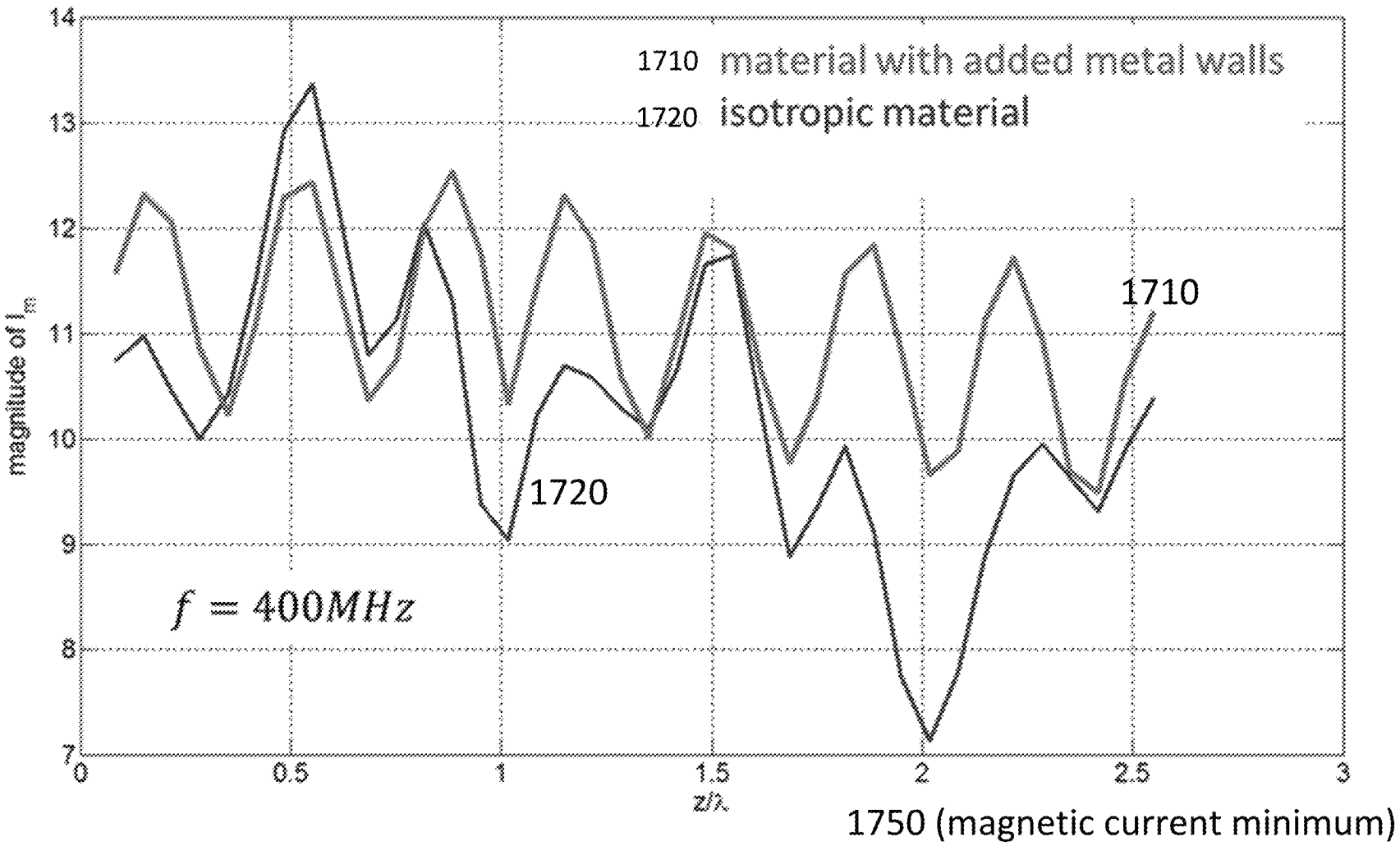
FIG. 17 depicts simulation results of an isotropic material (blue curve on bottom) and the same material with metal plates added to create an artificial anisotropy (red curve on top).

To demonstrate the viability of this technique, the inventors performed an experiment, in which the example flux channel described above, being 3.8 inches wide, 1.053 inches deep, filled with homogeneous isotropic $\mu r=80$ and $\varepsilon r=2$ material, and excited by a coax feed at its center, was simulated using ANSYS HFSS. The channel was terminated at both ends into the computer code's absorbing boundary conditions, which approximately simulate an infinitely long trough. FIG. 17 shows a plot of the magnetic current amplitude along the channel from the feed to a distance 2.6 wavelengths away at 400 MHz form this simulation. The isotropic material case is the blue curve 1720, whereas the material with metal plates added into it to create the desired artificial anisotropy yields the red curve 1710.

As thus shown in FIG. 17, the red curve 1710, representing material with metal plates added, is characteristic of a pure guided mode excited at the feed and propagating outwards from the feed in the "trapped wave" regime. The ten percent "ripple" overlaid on an otherwise smooth amplitude with a slight slope (this slope denoting that the trapped wave is radiating because it is not completely trapped at this frequency) is a result of the imperfect absorbing boundary terminations of the computer code used for the simulation (some reflected wave from the boundaries of the computational domain is being seen).

By contrast, the blue curve 1720, representing the isotropic material, shows what appears to be a severe beat phenomenon, exactly what would be expected from the co-existence of two traveling modes in a trough at the same time, i.e., the intended TE01 mode and the undesired TE21 mode (as illustrated in FIG. 16, above). As is well known in the case of structures supporting more than one propagating mode, a wave injected at a feed-point travels along the structure by transferring its energy back and forth from one mode to the other along the propagation direction (a phenomenon known as mode conversion). At distances from the feed where a significant amount of energy has been transferred to the TE21 mode, the magnetic current (the integral of the B field across the channel cross section) will show a minimum, as seen above in the blue curve 1720 of FIG. 17 at $z=2\lambda$ (or $z/\lambda=2$) labelled "1750 magnetic current minimum."

1.3 Exploiting the Frequency Dependent Dispersion of Realistic Permeable Materials It is noted that all real materials are frequency dependent. Therefore, they exhibit complex constitutive parameters (where the real part of the constitutive parameter denotes the energy storage capacity of the material, while the imaginary part denotes the dissipation of energy in the material, i.e., loss). It thus follows that there is no such thing as a lossless dielectric or lossless permeable material. While some have assumed that high efficiency permeable antennas require the real part of the material permeability to exceed the imaginary part, this concept is now known to be a fallacy.

Thus, highly efficient conformal permeable antennas may be designed and implemented where the imaginary part of the permeability of the material is comparable to or greater than the real part. In fact, the example NiZn tile material used for the spiral antenna described above is sold as an electromagnetic absorber for use in EMC chambers. This material has a Debye-like dispersion (frequency dependence) in its permeability, so that its real and imaginary parts are approximately equal at 3 MHz. Above that frequency the imaginary part becomes increasingly dominant. Yet, as noted above, the antenna attains Gain comparable to (that is, only 2 to 3 dB lower than) a metal spiral in free space. Thus, it is simply untrue that the preferred material for permeable antennas should have $\mu'>\mu''$.

This is an important fact because it means realistic dispersive materials may be used over wide frequency bands, and not only over those certain frequency bands where the real part dominates. Thus, dispersive properties in an antenna material may be in fact highly desirable. Thus, in various embodiments, the presence of a correct amount of loss, and therefore a correct dispersion in the permeability, may prevent the guided wave from being trapped inside the material at high frequencies. It may also prevent the excitation of higher order modes inside the channel. Therefore the high frequency regime above onset which would be sub-optimal for a lossless permeable material because it would tend to trap the wave, now becomes useful in the presence of a dispersive material.

It is noted that a judicious amount of loss forces the wave to travel on the surface of the flux channel and prevents it from being trapped inside the material. The result is a permeable flux channel that carries its wave close to the speed of light over a broader frequency range than an identical channel using a low loss material.

In embodiments, promoting such a true surface guidance is also a reason why the slitted plane at the mouth of the trough tends to guide the wave closer to the speed of light over a broad frequency range above onset: the edges of the slit pull the energy of the wave to the surface exposing more fields to the free space above and thus increasing the phase velocity, to bring it closer to the speed of light in free space.

To illustrate how this works (without limiting techniques described herein to this one example), the case of the 3.8 inches wide trough, 1.053 inches deep filled with a material of DC permeability=40 may be considered. The dispersion diagram, also known as the Omega-Beta ($\omega$-$\beta$) diagram, may be calculated using the transverse resonance technique, as described, for example, in Weeks, *Electromagnetic Theory for Engineering Applications*, Section 3.6. This closed-form calculation method (as opposed to a computational method) is valid over the full frequency range of interest from a frequency=½ the onset frequency (in the leaky-wave regime) to all frequencies above onset (the trapped wave regime). The $\omega$-$\beta$ diagram is the pair of plots showing the real and imaginary parts of the propagation constant, k, as a function of frequency. Where: $k=\beta-j\alpha$. The normalized phase velocity of the wave is given by Real Part (the phase constant) as follows:

$$\bar{v} = \frac{v_{phase}}{c} = \frac{k_0}{\beta}; \text{ where } k_0 = \frac{\omega}{c_0}, \text{ the free space propagation constant}$$

The attenuation constant is $\alpha$, related to the skin depth by $\delta=1/\alpha$. The results of the calculations are plotted in FIG. 18 in terms of the inverse of the phase velocity versus frequency (upper plot) and $\alpha/k_0$ versus frequency (lower plot).

Then, the propagation constant for the case of a fictitious material with lossless frequency independent $\mu=40$ (black curves) may be compared to a realistic material with dispersive permeability (the magenta curves in FIG. 18) given by the equation:

$$\mu_r = 1 + \frac{39}{1 + j\frac{f}{f_R}\frac{1}{0.75} - \left(\frac{f}{f_R}\right)^2},$$

where the resonance frequency $f_R=1.5$ GHz. In both cases the dielectric constant was set to 3.2.

The fact that there is loss in the realistic material slows down the leaky waves below onset and speeds up the trapped waves above onset, bringing the normalized phase velocity closer to 1 (speed of light), and in other words, increasing the radiation bandwidth of the channel.

As is expected, the trapped wave regime now exhibits some attenuation. And the attenuation constant in the leaky wave regime has been slightly increased. However, as stated above, the attenuation due to the material loss is not a significant detriment to the efficiency of these conformal permeable antennas. In particular, bringing the speed of the leaky waves closer to the speed of light results in giving those waves (those lower frequencies) access to a larger antenna structure and therefore increase the efficiency of their coupling to free space, thus enhancing radiation in spite of the moderate increase in loss.

Thus, in embodiments, the dispersion of the assumed material may be changed in a realistic way. It is known that families of magnetic materials may be, for example, characterized by their Snoek's Product, that is, the product of their DC permeability multiplied by the ferromagnetic resonance frequency. Thus, all NiZn bulk ferrites belong to the same family and have approximately the same Snoek's Product. They only differ in the amount of Chemical substitution of Zn into the base Nickel ferrite. It is here noted that this family of materials has a range of DC permeabilities that varies from approximately 10 to 3000, with corresponding ferromagnetic resonance frequencies ranging from about 200 MHz to 0.6 MHz. Accordingly, the product $\mu DC*f_R$ is approximately constant (within manufacturing variabilities) for all.

It is known that Snoek's Product is proportional to the maximum magnetic conductivity ($\sigma m=\omega\mu 0\mu''$, in ohms/meter) in the permeability spectrum of these materials. We call this maximum value the hesitivity, $h_m$. We have proven that the efficiency of conformal magnetodielectric antennas is uniquely determined by this quantity. For instance, the radiation efficiency of a permeable dipole is given by:

$$eff_{dipole} = \frac{1}{1 + \frac{6}{\left(\frac{\rho}{a}\right)^2 (kl)^3}\left(\frac{\omega\mu_0}{h_m}\right)} = \frac{1}{1 + \frac{\eta_0^2}{20 h_m Vol \cdot k_0^2}}.$$

This result has led to material selection rules whereby given the allowable volume that the antenna can occupy and its required efficiency, the hesitivity of the material required is determined. Since all materials in the same family have the same hesitivity (same Snoek's Product) the choice of which material to use for the application was thought to be left open. However, to maximize the impedance bandwidth of the antenna, the best choice may often be the material that has its peak $\mu''$ (the ferromagnetic resonance frequency) inside the band of operation.

In embodiments, it is here noted that the material with a given hesitivity that yields the maximum radiation bandwidth (not just impedance bandwidth) may be unambiguously selected by evaluating its effect on the $\omega$-$\beta$ diagram of the flux channel. It is the material that gives the flattest normalized velocity versus frequency with the least incurred loss.

To illustrate such an example design process, it is assumed that the material chosen above is a member of a permeable family whose ferromagnetic resonance may be lowered by adjustment of the manufacturing process. For instance, it may be assumed that the Crystalline Anisotropy field of the material may be reduced by change in the chemical composition or the deposition conditions (in the case of ferromagnetic metal thin films, for example, see Walser et al in "Shape-Optimized Ferromagnetic Particles with Maximum Theoretical Microwave Susceptibility", IEEE Trans. Magn. 34 (4) July 1998, pp. 1390-1392.) Then by Snoek's Law, the DC permeability may be increased by the same factor that ferromagnetic resonance is dropped.

Figure 19:
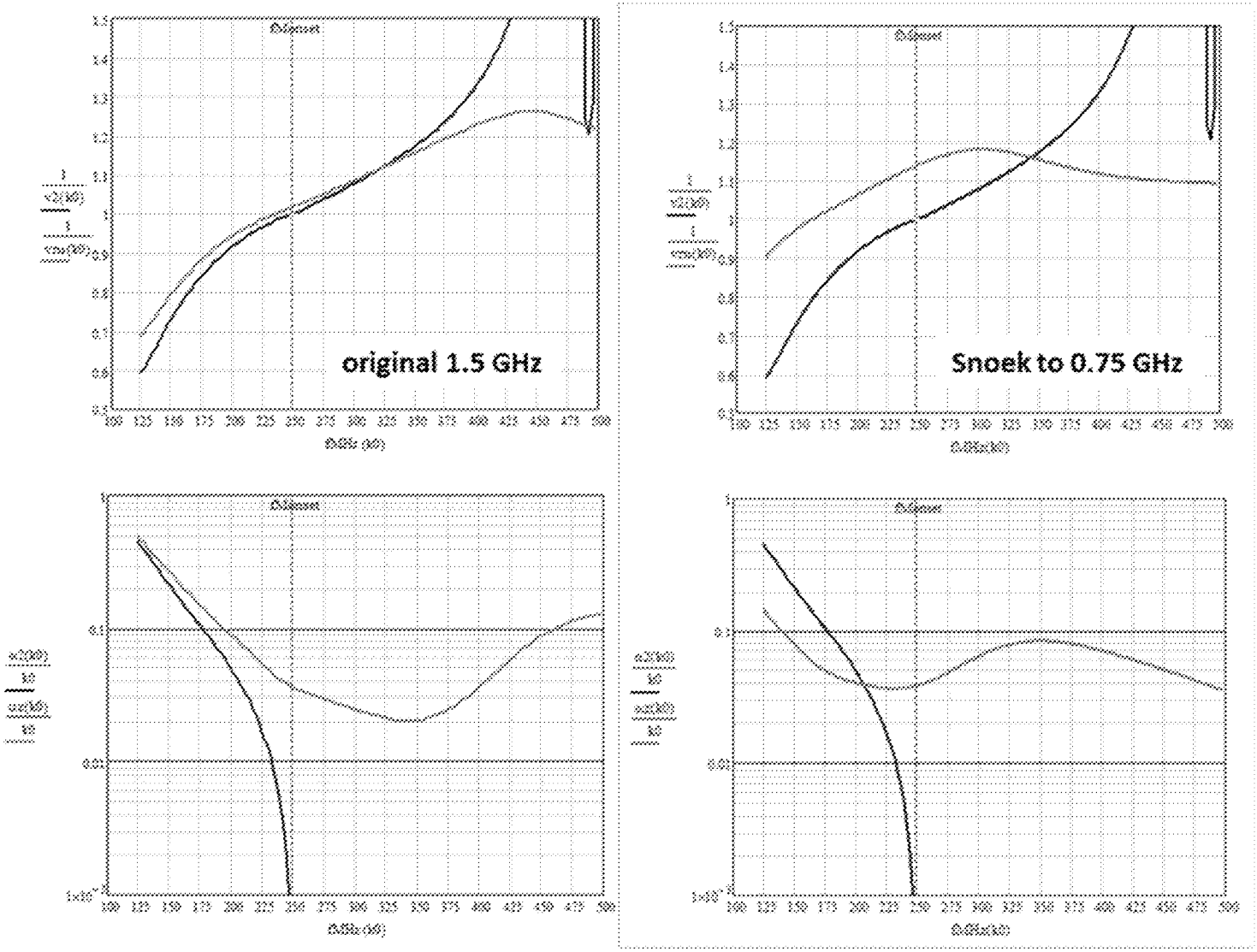
FIG. 19 illustrates a comparison of the materials in FIG. 18 (left side) with a "Snoeked" version, having a resonance at 750 MHz.

FIG. 19 illustrates a previous result of the material with its resonance at 2.5 GHz compared with a "Snoeked" version, with resonance at 750 MHz. The black curves are for the fictitious original $\mu=40$ material. It is seen from the phase velocity plot that bringing the resonance to 750 MHz flattened the velocity to such a degree that from 125 MHz through 500 MHz (and beyond) the speed of propagation falls within 1.06 $c_0$+/−18%. Another important observation from the phase velocity plot is that the maximum is observed in the black curves near 450 MHz, indicating that the appearance of the next higher order mode, when ¾ wavelengths fit within the depth of the trough (TE02), may be eliminated by introducing material dispersion. It is the appearance of these higher order modes that causes the drop in total radiated power seen in the bottom image of FIG. 3. Thus, in embodiments, making the material dispersive, that is, frequency dependent, and correctly placing its resonance frequency may dramatically change the guiding characteristics of the channel.

In embodiments, this change may be used to create a channel that guides waves near the speed of light for an extremely broad range of frequencies, not only because the loss pushes the fields to the surface but because the frequency dependent change in permeability changes the transverse resonance condition of the channel such that there is no longer a unique (real) onset frequency, but instead a continuous distribution of complex onset frequencies over the entire band.

The attenuation constant plot further shows why this procedure yields a superior permeable broadband antenna.

The attenuation constant below the original onset frequency in the leaky wave regime has now been dropped below that of the ideal fictitious material. This is because the guidance properties of a lossy surface (known from the classic problem of a dipole radiating over a lossy earth) eventually overcome the leaky wave tendencies of the shallow channel. Thus, in this case, overall, the attenuation constant may be kept below 0.1 $k_0$. Over the band from 150 MHz to over 500 MHz, the average is −2.5 dB per wavelength, implying just a 25% drop in amplitude after travelling one wavelength.

Since, as described above in the discussion on the spiral antenna, the active region of the spiral is one wavelength in circumference, this moderate amount of loss has only a small effect on the performance of the antenna, as has been demonstrated in the example where the material used was an absorbing NiZn ferrite tile.

It thus remains to decide, based on the requirements of the communication system and the type of antenna being considered, where precisely to place the resonant frequency of the material dispersion. This is a standard trade-off exercise that may be readily performed by using the transverse resonance analysis as described herein.

Figure 20:
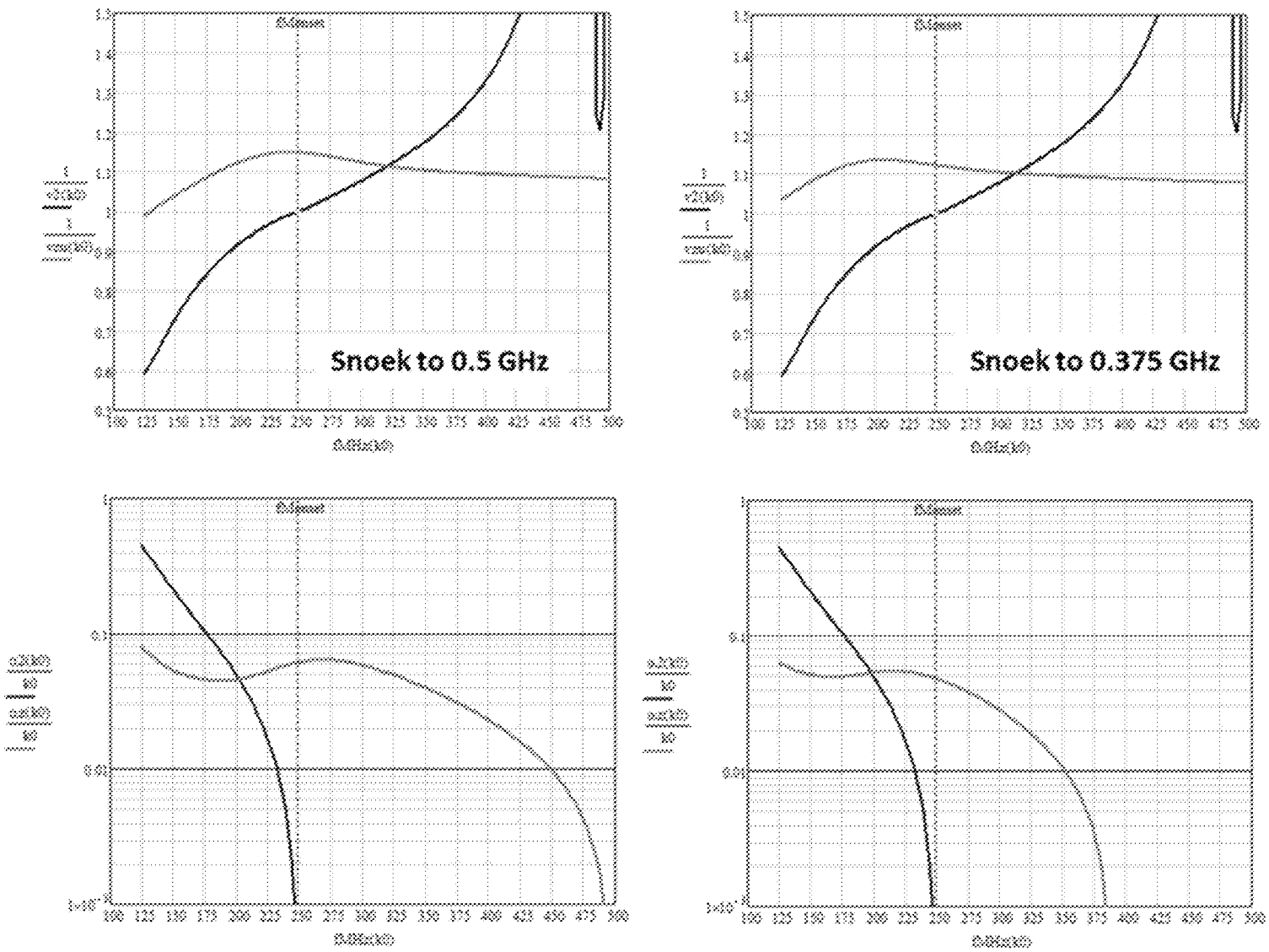
FIG. 20 illustrates an extension of the results of the "Snoeked" version of the materials, as shown in FIG. 19, when the ferromagnetic resonance is further moved down in frequency to 500 MHz and 375 MHz, respectively.

For the sake of completeness, FIG. 20 shows the results when the ferromagnetic resonance is further moved down in frequency. FIG. 20 thus shows the cases where the frequency has been moved from the 750 MHz case as described above with reference to the right image of FIG. 19, to 500 MHz, and then to 375 MHz as shown in FIG. 20. At first glance the results are startling. As would be expected, the "onset" (when the speed of propagation crosses the speed of light) is pushed back because now there is a higher μ at low frequencies but, in addition, the attenuation constant has dropped at all frequencies relative to the previous case. Eventually the attenuation constant is reduced overall and the propagation speed brought within 10 percent over a very wide frequency range. Essentially the case of a "magnetic conductor", the formal dual of an electric conductor, has been here approached.

These results thus extend the notion that the loss of permeable materials is not a hindrance to their use as conformal antennas. In embodiments, such dispersion, inevitable in realistic materials, is in fact both desirable and necessary to enable the creation of magnetic flux channels that approach the ideal electromagnetic dual behavior of conventional metal antennas in free space.

Beyond enabling the design of highly efficient wideband conformal permeable antennas, this result may also serve as guidance for magnetic material development of future materials. It is noted that even though the trend over the last several decades has been the development of magnetic materials with increasingly high resonance frequencies, and even at the expense of the initial permeability, because for many magnetic recording and microwave device applications there is a requirement for low μ" with increasing operational frequency, that may not be the proper direction to go in for maximizing the performance of permeable antennas. As may now be appreciated, development for antenna applications would be more proper in the opposite direction, e.g., drop the resonance frequency and raise the initial permeability.

Figure 21:
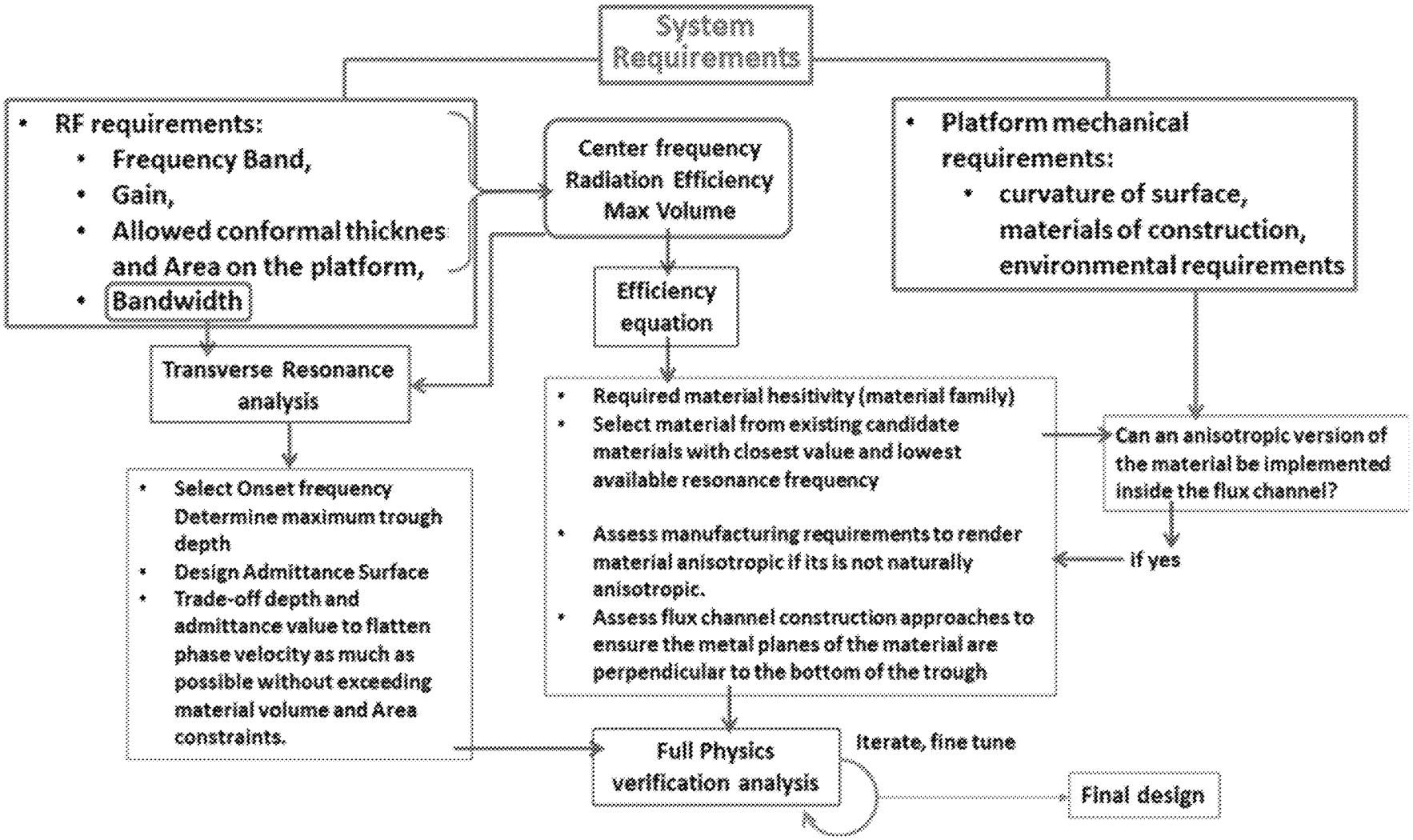
FIG. 21 illustrates an example design process according to various embodiments.

An example design process, based on the several salient points of the description of FIGS. 12-20 above, is presented in FIG. 21.

2.0 Example Antennas

Figure 22:
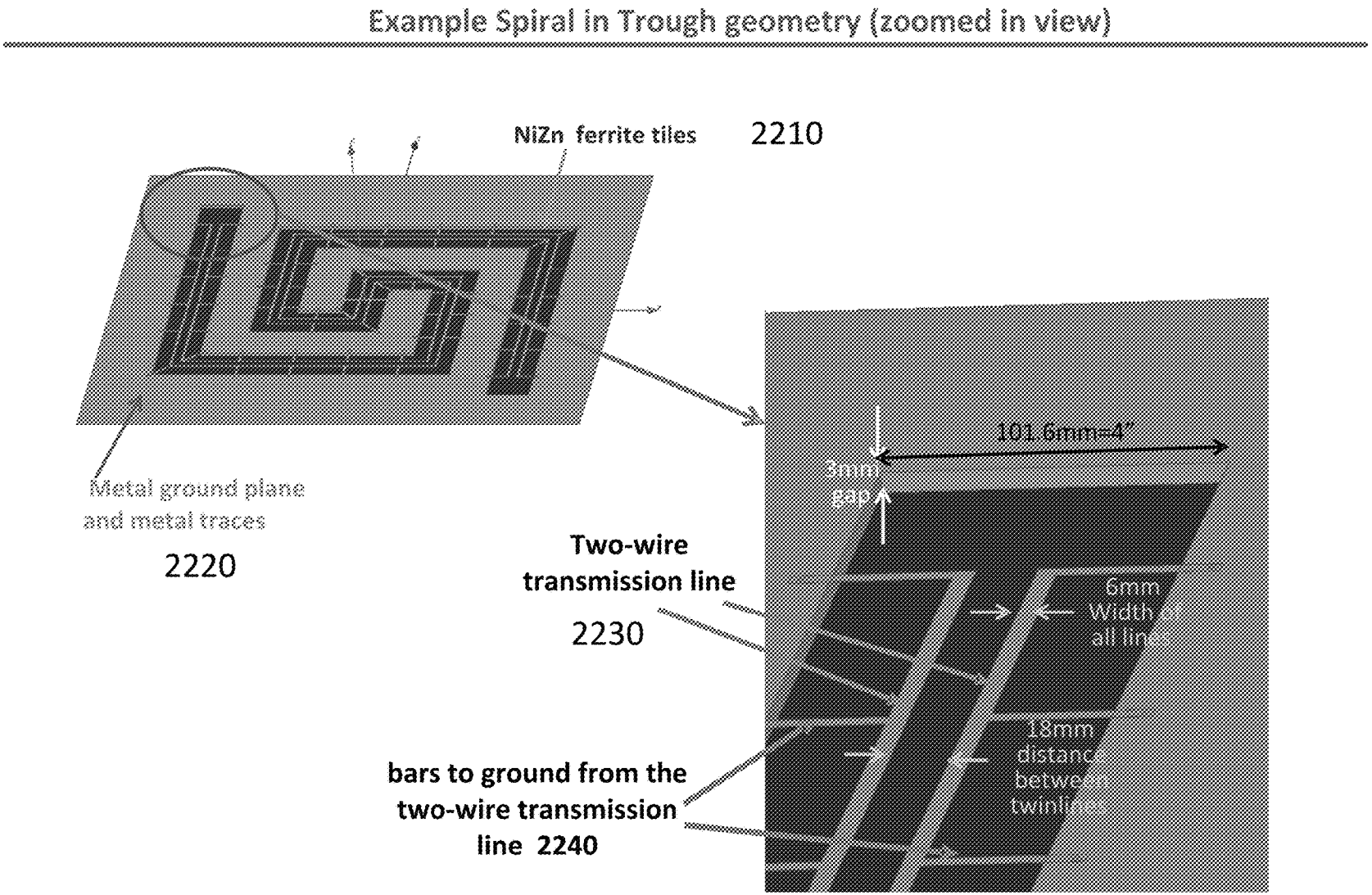
FIG. 22 illustrates further details of the improved ferrite spiral antenna of FIG. 10 according to various embodiments.

FIGS. 22-29, next described, provide details of two example antennas according to various embodiments. FIGS. 22 through 26 illustrate further details of the improved (in trough) ferrite spiral antenna of FIG. 10 according to various embodiments. The example in-trough spiral antenna has a metal ground plane and metal traces 2220, and may be comprised of NiZn ferrite tiles, as noted above. With further reference to FIG. 22, right image (a magnified portion of one end of the spiral), there are shown example dimensions of or related to, a capacitive admittance provided on example NiZn ferrite tiles 2210, comprising a two-wire transmission line 2230. There are also shown bars to ground 2240 from the two-wire transmission line 2230. There is also shown an example width of ~4 inches (101.6 mm), and a 3 mm gap. Each line of the two-wire transmission line 2230 has a 6 mm width, for example, and there may be, for example, an 18 mm distance between the two lines.

Figure 23:
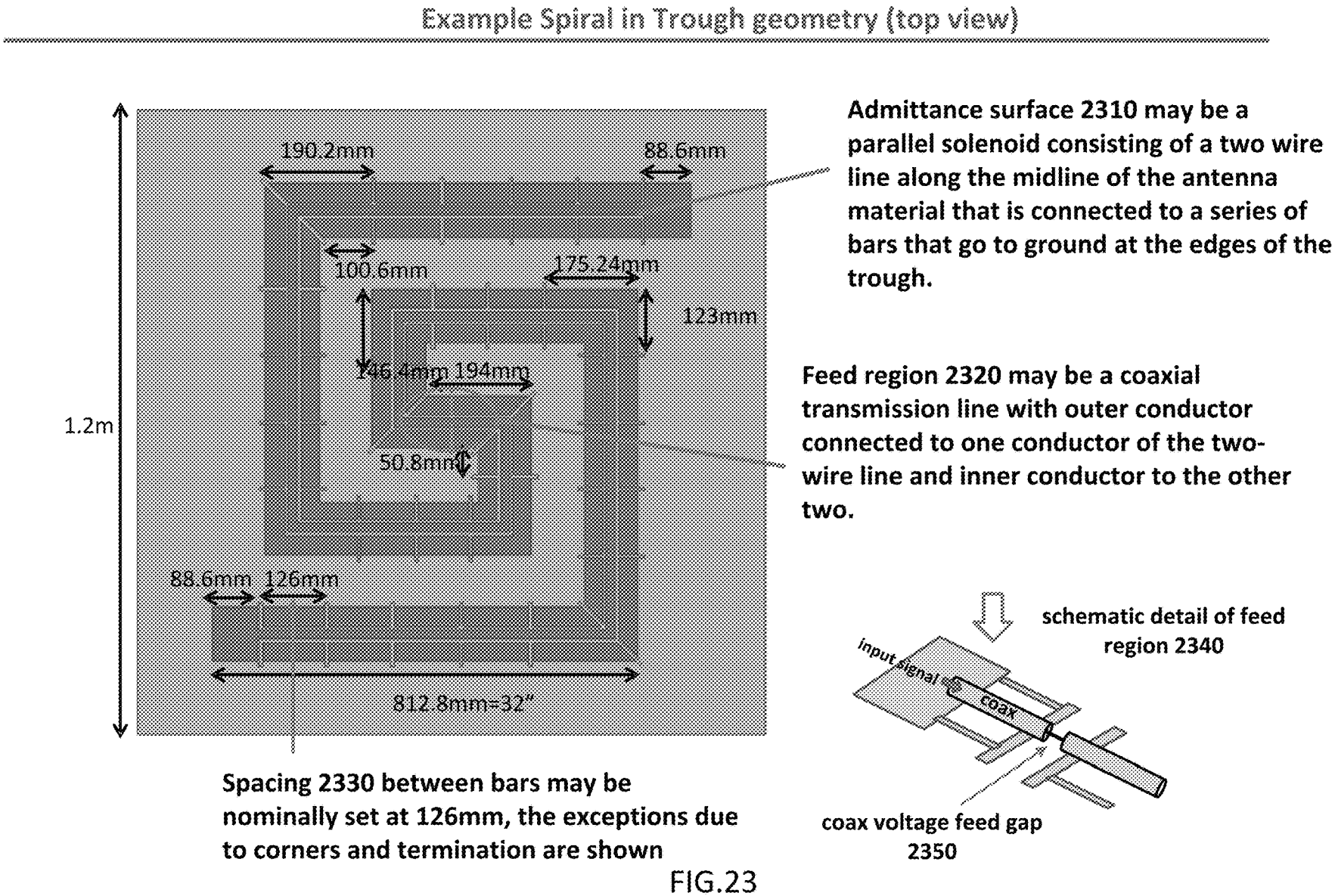
FIG. 23 illustrates still further details of the improved ferrite spiral antenna of FIG. 10, in particular as may relate to the admittance surface, and feed region of the admittance surface, according to various embodiments.

FIG. 23 illustrates still further details of the improved ferrite spiral antenna of FIGS. 10 and 22, in particular as may relate to the admittance surface and the feed region of the admittance surface, according to various embodiments. As shown in FIG. 23, the admittance surface 2310 may be a parallel solenoid consisting of a two wire line along the midline of the antenna material that is connected to a series of bars that go to ground at the edges of the trough. In this example, a spacing 2330 between bars may be nominally 126 mm, and exceptions due to corners and termination are shown. Feed region 2320 may be a coaxial transmission line with an outer conductor connected to one conductor of two-wire line 2310 and an inner conductor to the other, and, as shown, the coaxial voltage may have a feed gap 2350, as shown in the schematic detail provided at the bottom right of FIG. 23.

Figure 24:
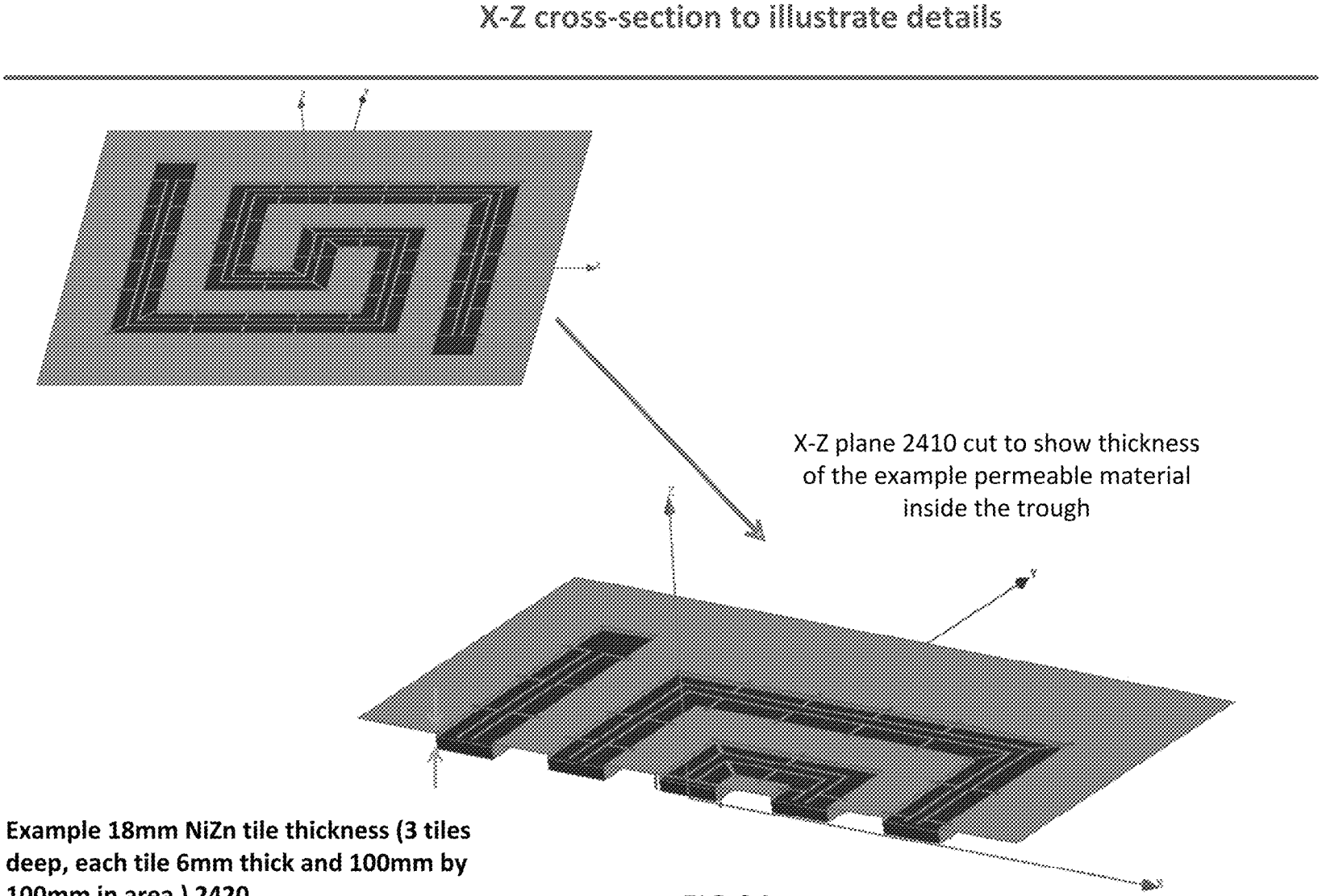
FIG. 24 illustrates a vertical (X-Z) cross section of the ferrite spiral antenna of FIG. 10 and example dimensions of the ferrite tiles used in it, according to various embodiments.

FIG. 24 illustrates a vertical (X-Z) cross section 2410 of the ferrite spiral antenna of FIGS. 22 and 23 and example dimensions of the ferrite tiles according to various embodiments. These include example thickness 2420 of 18 mm, comprising three tiles each 6 mm thick, and 100 mm by 100 mm (~4 inches by 4 inches) in area.

FIG. 25 illustrates permeability of example NiZn ferrite tiles, according to various embodiments. With reference thereto, an example Archimedean Spiral 2520 is shown. The Archimedean Spiral 2520 may, for example, be built out of 123 spirals, each having a 4×4 inch cross sectional area, with a thickness of 6 mm, as shown. The spiral may, for example, be 3 tiles deep (e.g., for a thickness of 18 mm). The plot at 2510 depicts permeability versus frequency (both real μ' (in red) and imaginary μ" (in blue)) of the NiZn ferrite tiles. As may be seen in the larger plot of 2510, for the depicted range of interest, the imaginary permeability exceeds the real permeability, as described above.

Figure 26A:
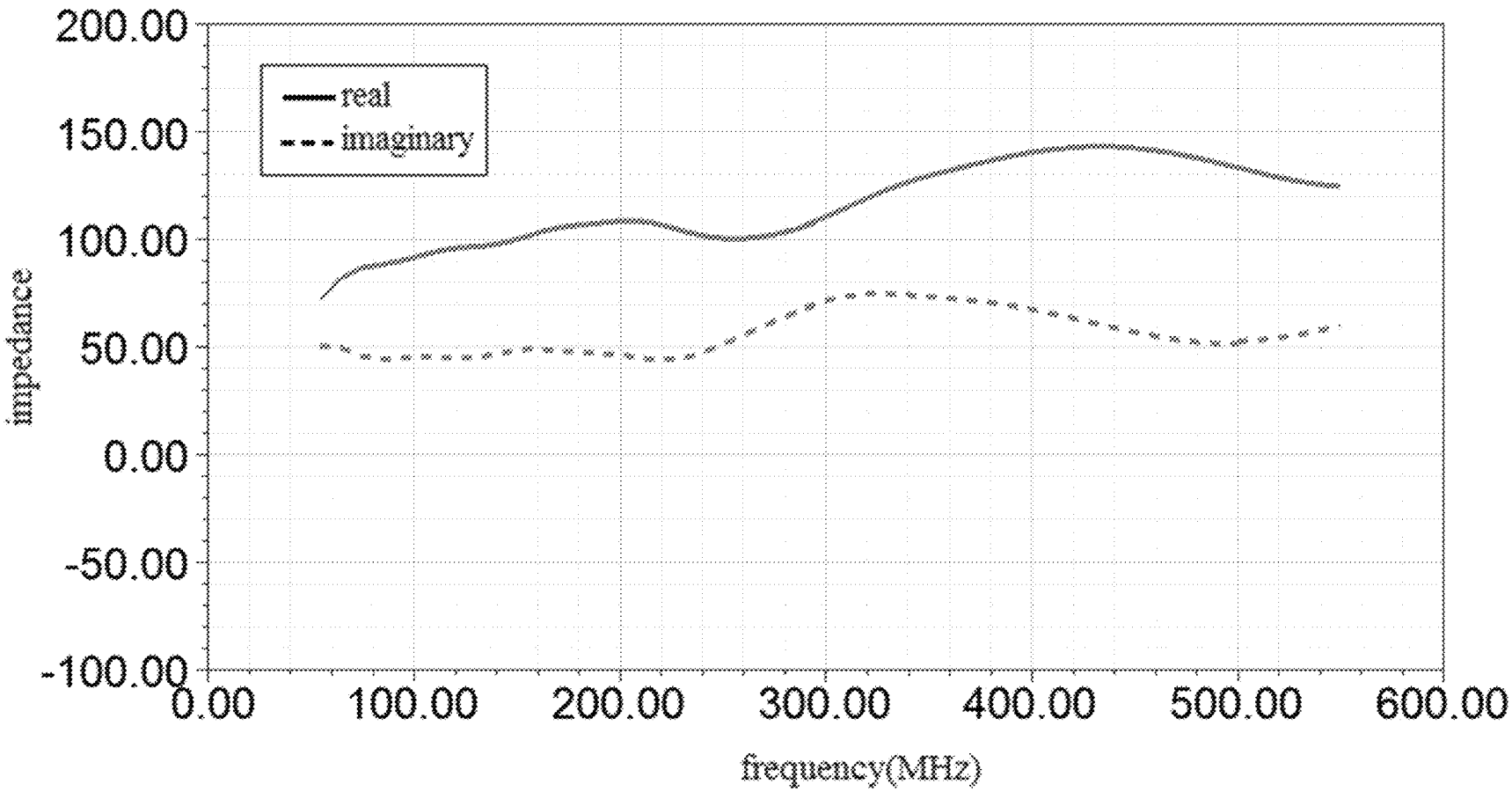
FIG. 26A depicts a plot of impedance versus frequency.
Figure 26B:
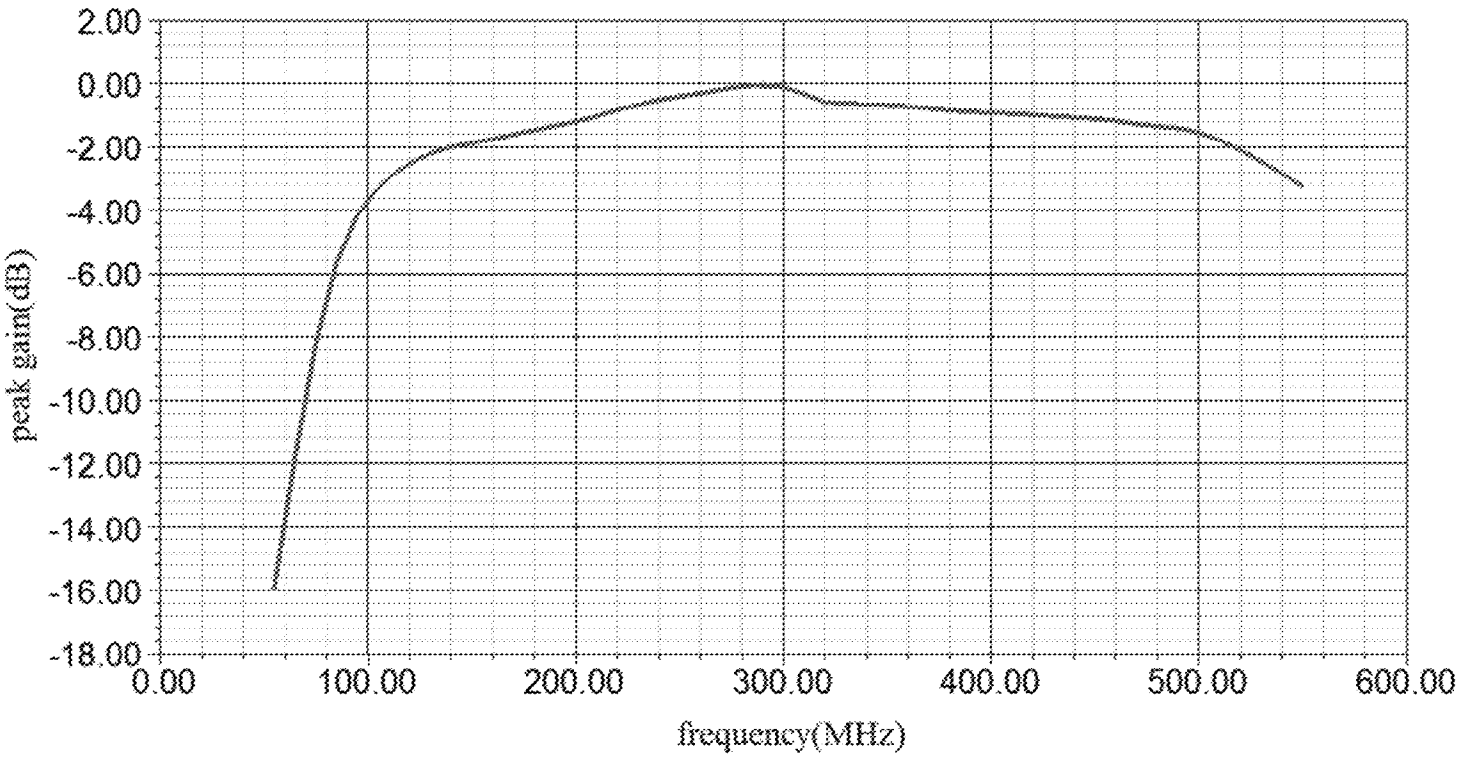
FIG. 26B depicts a plot of peak gain versus frequency, for the example NiZn ferrite tiles of FIGS. 22-24, according to various embodiments.

Similarly, FIG. 26A depicts a plot of impedance versus frequency, and FIG. 26B depicts a plot of peak gain versus frequency, for the example spiral antenna of FIGS. 22 and 23, composed of the NiZn ferrite tiles as described above. With reference to FIG. 26A, the real impedance is shown in a solid line, and the imaginary impedance in the dashed line. As shown in FIG. 26B, peak gain has a maximum at 300 MHz, and remains less than, but still close to, that value between 140 MHz and 500 MHz.

Figure 27:
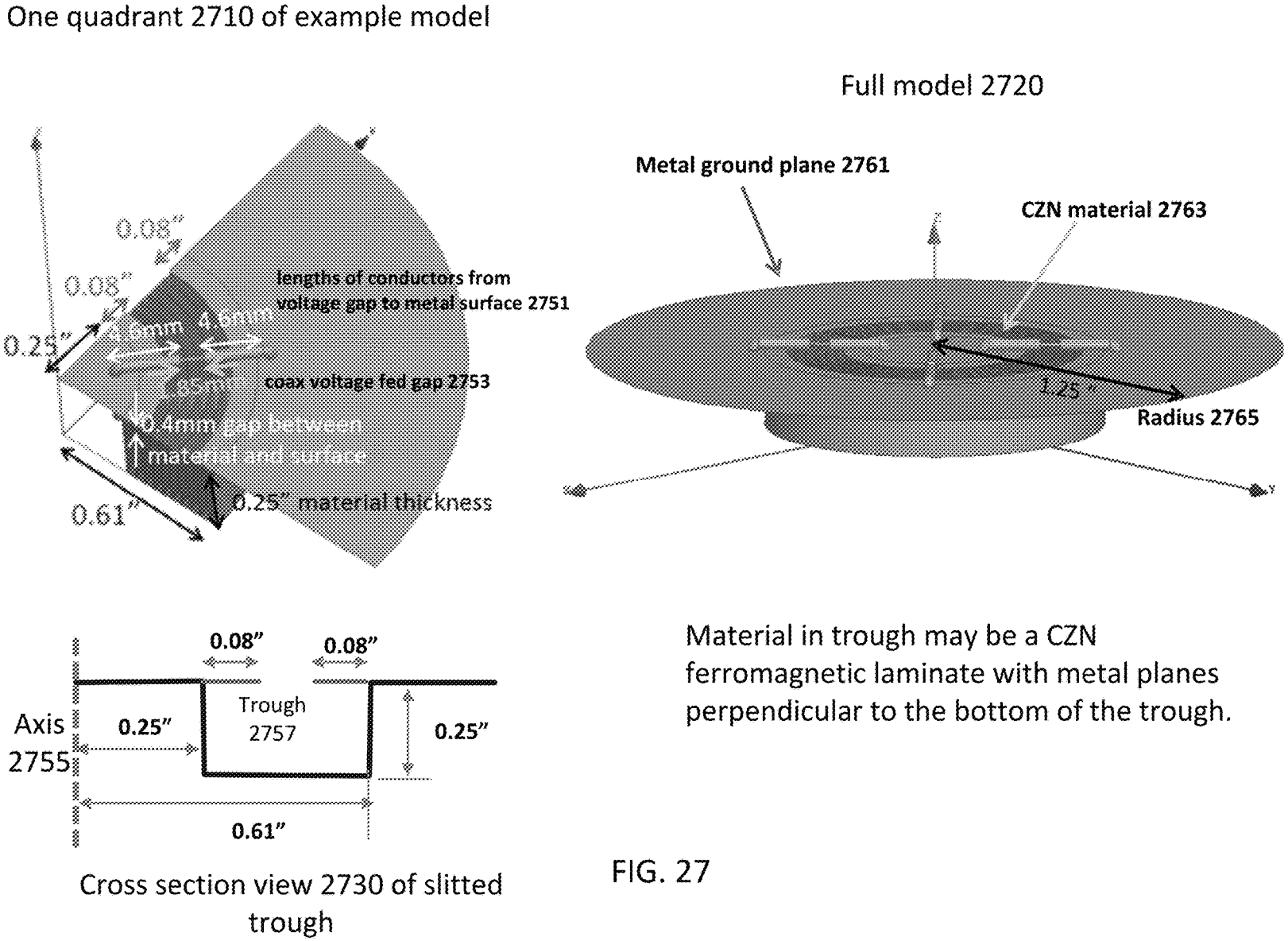
FIG. 27 illustrates an example high frequency circular antenna, according to various embodiments.

FIG. 27 illustrates an alternate antenna structure, that of an example high frequency circular slitted in-trough antenna according to various embodiments, and shows detailed example dimensions of it. Both an example quadrant 2710 of the antenna, as well as a full model 2720, each with exemplary dimensions, are shown. In this example antenna, the material in the trough is a CZN ferromagnetic laminate with the metal planes perpendicular to the bottom of the trough. As shown in full model 2720, there may be a metal ground plane 2761, in which a trough is provided, comprising CZN material 2763. The CZN material may be a ferromagnetic laminate with metal planes provided that are perpendicular to the bottom of the trough, as described above. The antenna may have, for example, a radius 2765 of length 1.25" from a central axis to an outer edge. As shown in quadrant 2710 of the example model, there may be a coax fed voltage gap 2753, for example, of length 1.85 mm, where lengths of conductors 2751 from the voltage gap to the metal surface may be, for example, 4.6 mm. Other example dimensions are also shown in the figure.

Finally, FIG. 27 also illustrates a cross section view 2730 of the slitted trough 2757 and adjacent structures. With reference thereto, as well as to quadrant 2710, the material thickness of the trough may be 0.25", which may also be the distance between central axis 2755 and the inner wall of trough 2757. Metal ground plate 2761 may overlap the trough, on each side of trough 2757, by, for example, 0.08". Finally, the distance between central axis 2755 and the outer wall of trough 2757 may be, for example, 0.61". It is noted that these dimensions are merely exemplary, of one example embodiment, and are understood to be in no way limiting.

Figure 28:
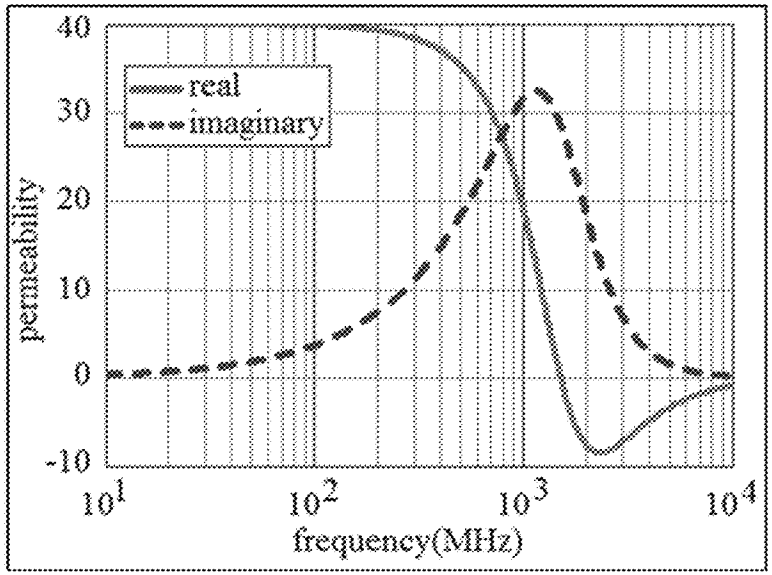
FIG. 28 depicts a plot of real and imaginary permeability versus frequency, of the CZN material used in the example antenna of FIG. 27.
Figure 29:
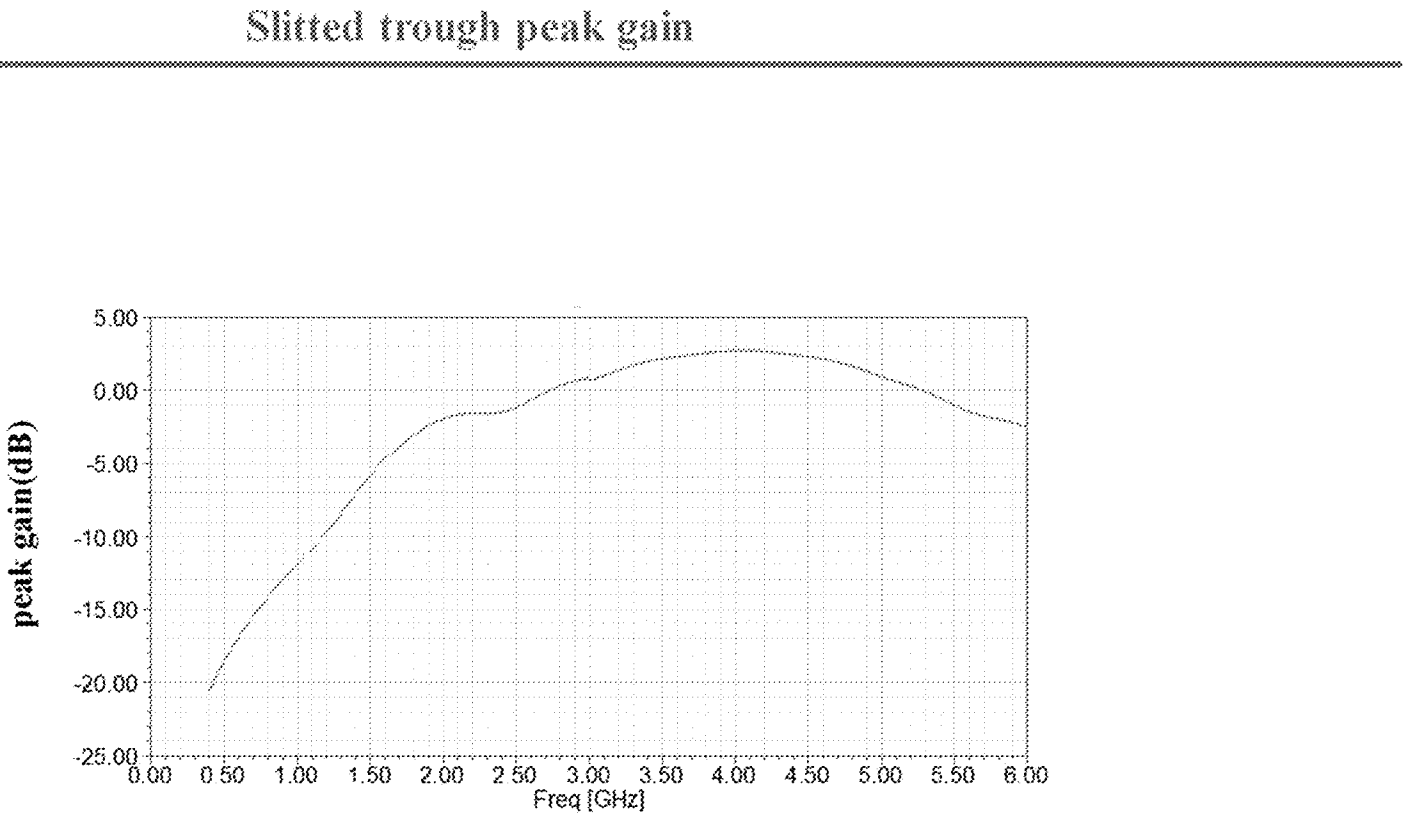
FIG. 29 depicts a plot of peak gain versus frequency for the example antenna of FIG. 27.

FIG. 28 depicts a plot of permeability versus frequency of the CZN material used in the example circular in-trough antenna of FIG. 27, and FIG. 29 depicts a plot of peak gain versus frequency for the example slitted trough of the antenna of FIG. 27.

It is here noted that an optimal conformal permeable antenna flux channel may be defined as one consisting of antenna elements or sections that behave as closely as possible to the electromagnetic dual of conventional metal antennas in free space. This implies that the flux channel may preferably guide its magnetic current near the speed of light over the widest possible band of frequencies and with the minimum practical loss. In embodiments, with reference once again to FIG. 21, an approach to the construction of these optimal flux channels may be as follows:

Based on the system requirements of operational frequency band and gain, and constraints of available installation area and thickness for the antenna, in embodiments, the following process may be performed:

Select antenna type and shape;

Select a permeable material that will meet efficiency (Gain) requirements within volume constraints;

To the degree that the radii of curvature of the platform surface (and other mechanical constraints such as the composition of the selected material) allow it, implement the permeable material as a laminate structure where conducting planes are to be placed perpendicular to conducting surface of the platform;

Design flux channel as a conducting trough in the conducting surface of the platform;

Design cross section of the trough such that for a chosen permeable material filling it, the surface wave guidance onset frequency falls within the band of operation near the bottom of the band, nominally such that the bottom of the band is approximately 0.5 the onset frequency;

Design cross section of the trough and the admittance surface at its mouth to obtain a phase velocity of propagation as flat as possible, and as close as possible to the speed of light in free space, as a function of frequency, over the band of operation;

Perform a final engineering trade-off of the features using full physics modeling of the designed structure, trading off as necessary bandwidth, input impedance, and gain; and Fine tune the design, build, and test.

Thus, in summary, three features of permeable antennas have been disclosed in the various descriptions provided above:

a flux channel designed as a metal trough with an admittance surface at the mouth of the trough as a means for maximizing the radiation bandwidth and as a means for tailoring the input impedance at the feed of the antenna;

use of a particular anisotropy in the permeable materials used equivalent to the insertion of conducting metal planes perpendicular to the bottom of the trough to suppress the onset of undesired, poorly radiating, higher order modes and parasitic modes; and use of dispersive permeable materials in their high loss frequency range as a means to increase the radiation bandwidth and suppress higher order modes by tailoring the omega-beta diagram.

In embodiments, the following design methods may be implemented:

Maintain the phase velocity of propagation of a wave guided by a flux channel within approximately +/30% of the speed of light, to maximize the radiated power;

Provide a surface admittance on the surface of the magnetodielectric flux channel for this purpose by flattening the frequency dependence of the phase constant of the omega-beta diagram near the onset frequency; and Utilize judicious choice of frequency variation of the permeability of the material filling the channel as well as its loss, to alter the omega-beta diagram. It is noted that whereas the conventional omega-beta diagram analysis assumes a material of frequency-independent constant permeability leading to a single unique onset frequency for a given flux channel cross section, methods according to various embodiments result in a continuous distribution of onset frequencies that therefore allows the phase velocity to remain close to the speed of light over a very wide frequency range.

The foregoing description of one or more implementations provides illustration and description, but is not intended to be exhaustive or to limit the scope of embodiments to the precise form disclosed. Modifications and variations are possible in light of the above teachings or may be acquired from practice of various embodiments.

The invention claimed is:

1. A permeable antenna, comprising:

a flux channel comprising a permeable material inside a trough in a conducting ground plane, the trough having a depth d and a width b; and a capacitive shunt admittance provided at a mouth of the trough, wherein a phase velocity of propagation of a wave guided by the permeable material in the trough is to be maintained within a range of substantially 0.76 c to 1.36 c, where c is the speed of light.

2. The permeable antenna of claim 1, wherein the capacitive shunt admittance is one of: a slitted conducting plane or a single feed parallel solenoid, fed by a transmission line at a center loop.

3. The permeable antenna of claim 2, wherein the transmission line is one of coaxial or microstrip.

4. The permeable antenna of claim 1, wherein the permeable material is anisotropic.

5. The permeable antenna of claim 1, wherein the permeable material is a ferromagnetic laminate comprising alternating thin metal films with thin insulating dielectrics.

6. The permeable antenna of claim 5, wherein the ferromagnetic laminate comprising alternating thin metal films with thin insulating dielectrics are oriented to be perpendicular to a bottom of the trough.

7. The permeable antenna of claim 1, wherein the permeable material comprises a plurality of ferrite tiles in the shape of an Archimedean spiral.

8. The permeable antenna of claim 7, wherein the plurality of ferrite tiles are divided into thin segments aligned with a flux channel axis, and separated by thin metal planes.

9. The permeable antenna of claim 1, wherein the permeable material comprises a plurality of ferrite tiles divided into thin segments aligned with a flux channel axis, and separated by thin metal planes.

10. The permeable antenna of claim 9, wherein the Zinc content of the ferrite tiles is adjusted to set a frequency of ferromagnetic resonance in the desired operating frequency bandwidth of the antenna.

11. The permeable antenna of claim 1, wherein a permeability spectrum of the permeable material is altered in manufacturing to set a frequency of ferromagnetic resonance.

12. The permeable antenna of claim 11, wherein the set frequency is within a desired operating frequency bandwidth of the antenna.

13. The permeable antenna of claim 1, wherein the permeable material comprises a CZN ferromagnetic laminate provided in the shape of a ring.

14. The permeable antenna of claim 13, wherein the CZN ferromagnetic laminate is oriented with metal layers perpendicular to a bottom of the trough.

15. The permeable antenna of claim 14, wherein the CZN ferromagnetic laminate oriented with metal layers perpendicular to a bottom of the trough comprises a coaxial voltage fed gap.

16. The permeable antenna of claim 1, wherein the permeable material comprises a dispersive permeable material in a high loss frequency range.

17. The permeable antenna of claim 16, wherein the permeable material is to further suppress higher order wave modes other than a TE01 mode.

18. The permeable antenna of claim 1, wherein the permeable material is to support a continuous distribution of onset frequencies.

* * * * *